US010170825B2

(12) United States Patent
Niihara et al.

(10) Patent No.: US 10,170,825 B2
(45) Date of Patent: Jan. 1, 2019

(54) ANTENNA DEVICE

(71) Applicant: Fujikura Ltd., Tokyo (JP)

(72) Inventors: Yoshihiro Niihara, Sakura (JP); Yuichiro Yamaguchi, Sakura (JP); Hiroshi Chiba, Tokyo (JP); Masaki Ueyama, Tokyo (JP); Ning Guan, Sakura (JP); Hiroiku Tayama, Sakura (JP)

(73) Assignee: FUJIKURA LTD., Tokyo (JP)

( * ) Notice: Subject to any disclaimer, the term of this patent is extended or adjusted under 35 U.S.C. 154(b) by 18 days.

(21) Appl. No.: 15/508,993

(22) PCT Filed: Sep. 12, 2016

(86) PCT No.: PCT/JP2016/076871
§ 371 (c)(1),
(2) Date: Mar. 6, 2017

(87) PCT Pub. No.: WO2017/043663
PCT Pub. Date: Mar. 16, 2017

(65) Prior Publication Data

US 2017/0279181 A1 Sep. 28, 2017

(30) Foreign Application Priority Data

Sep. 11, 2015 (JP) ..... 2015-179944
Nov. 20, 2015 (JP) ..... 2015-228125
(Continued)

(51) Int. Cl.
*H01Q 1/38* (2006.01)
*H01Q 1/20* (2006.01)
(Continued)

(52) U.S. Cl.
CPC ..... *H01Q 1/38* (2013.01); *H01Q 1/1214* (2013.01); *H01Q 1/20* (2013.01); *H01Q 1/3275* (2013.01);
(Continued)

(58) Field of Classification Search
CPC ..... H01Q 1/1214; H01Q 1/20; H01Q 1/3275; H01Q 1/3283; H01Q 9/0414; H01Q 9/16; H01Q 9/30; H01Q 9/40
See application file for complete search history.

(56) References Cited

U.S. PATENT DOCUMENTS

2006/0032926 A1* 2/2006 Baba ..... G06K 19/07749 235/492
2006/0267844 A1 11/2006 Yanagi et al.
(Continued)

FOREIGN PATENT DOCUMENTS

EP 1760825 A1 3/2007
EP 2403327 A2 1/2012
(Continued)

OTHER PUBLICATIONS

Extended (supplementary) European Search Report dated Apr. 4, 2018, issued in counterpart European Application No. 16838078.0. (7 pages).
(Continued)

*Primary Examiner* — Hoang Nguyen
(74) *Attorney, Agent, or Firm* — Westerman, Hattori, Daniels & Adrian, LLP

(57) ABSTRACT

The present invention includes: a film antenna (10); a cable (20) which is connected to a feed section (14) of the film antenna (10); and a support (30) around which at least part of the film antenna (20) is wound, the support (30) including a holding section for holding the cable (20).

14 Claims, 18 Drawing Sheets

(30) Foreign Application Priority Data

| | | |
|---|---|---|
| Jun. 13, 2016 | (JP) | 2016-117495 |
| Jun. 13, 2016 | (JP) | 2016-117496 |
| Jun. 13, 2016 | (JP) | 2016-117497 |
| Sep. 12, 2016 | (JP) | 2016-178056 |

(51) Int. Cl.

| | |
|---|---|
| ***H01Q 1/32*** | (2006.01) |
| ***H01Q 9/04*** | (2006.01) |
| ***H01Q 1/12*** | (2006.01) |
| ***H01Q 9/40*** | (2006.01) |
| *H01Q 9/16* | (2006.01) |
| *H01Q 9/30* | (2006.01) |

(52) U.S. Cl.
CPC ..... *H01Q 1/3283* (2013.01); *H01Q 9/0414* (2013.01); *H01Q 9/40* (2013.01); *H01Q 9/16* (2013.01); *H01Q 9/30* (2013.01)

(56) References Cited

U.S. PATENT DOCUMENTS

| | | | | |
|---|---|---|---|---|
| 2012/0013510 | A1 | 1/2012 | Yagi et al. | |
| 2012/0097425 | A1 | 4/2012 | Sakai et al. | |
| 2013/0342405 | A1* | 12/2013 | Ueno | H01Q 1/3275 343/713 |

FOREIGN PATENT DOCUMENTS

| | | | |
|---|---|---|---|
| JP | 2004-260586 | A | 9/2004 |
| JP | 2009-118002 | A | 5/2009 |
| JP | 2011-135549 | A | 7/2011 |
| JP | 2013-255094 | A | 12/2013 |

OTHER PUBLICATIONS

International Search Report dated Nov. 29, 2016, issued in counterpart application No. PCT/JP2016/076871 . (3 pages).

* cited by examiner

ANTENNA DEVICE

TECHNICAL FIELD

The present invention relates to an antenna device including a film antenna. The present invention also relates to a method of manufacturing such an antenna device.

BACKGROUND ART

As an antenna that is easy to mount, a flexible film antenna is widely used. Note here that a film antenna refers to an antenna including a flexible dielectric film and an antenna conductor provided on a surface of the dielectric film. For example, a film antenna that is used by being attached to a window of an automobile is widely known.

In order to form a three-dimensional antenna by use of a flexible film antenna, it is preferable to maintain a three-dimensional structure of an antenna conductor by attaching/winding the film antenna to/around a highly rigid support. This is because a change in three-dimensional structure of the antenna conductor results in a change in antenna characteristic.

Note that a high-frequency current is supplied to/from a film antenna via a cable (e.g. a coaxial cable) that is connected to a feed section including two connection points. The film antenna and the cable are ordinarily connected by soldering a hot side/cold side conductor of the cable (an inner/outer conductor of the coaxial cable) to two connection points provided in an antenna conductor of the film antenna. Thus, the cable which is pulled by a powerful force may come off of the feed section (two connection points) of the film antenna. In view of this, it is important for an antenna device including a film antenna and a cable to have greater durability (connection reliability) with respect to pulling of the cable.

Examples of a literature disclosing a technique that may contribute to a solution to such a problem encompass Patent Literature 1. According to Patent Literature 1, by fitting a cable into a groove provided in a holding member and causing the holding member to hold the cable, even in a case where one end of the cable is pulled, it is difficult for a force by which the one end of the cable is pulled to be transmitted to the other end of the cable. Thus, by causing the holding member to hold the cable which is connected to a film antenna, it is possible to increase durability with respect to pulling of the cable.

CITATION LIST

Patent Literature

[Patent Literature 1]
Specification of European Patent No. 2403327 (Publication Date: Jan. 4, 2012)

SUMMARY OF INVENTION

Technical Problem

Note, however, that the holding member disclosed in Patent Literature 1 has a function of increasing durability with respect to pulling of the cable but has no function of maintaining a three-dimensional structure of an antenna conductor. Thus, it is impossible to stabilize an antenna characteristic merely by causing the holding member disclosed in Patent Literature 1 to hold the cable which is connected to the film antenna. Further, use of (i) a support to/around which to attach/wind a film antenna and (ii) the holding member disclosed in Patent Literature 1 in combination to maintain a three-dimensional structure of an antenna conductor causes a problem of causing a structure to be complicated or larger.

The present invention has been made in view of the problems, and an object of the present invention is to (i) prevent an antenna device, which includes a film antenna and a cable connected to the film antenna, from causing a structure to be complicated or larger and (ii) allow the antenna device to have a more stable antenna characteristic and greater durability with respect to pulling of a cable.

Solution to Problem

In order to attain the object, an antenna device in accordance with an aspect of the present invention includes: a film antenna; a cable which is connected to a feed section of the film antenna; and a support, around which at least part of the film antenna is wound, the support including a holding section for holding the cable.

Advantageous Effects of Invention

The present invention makes it possible to (i) prevent an antenna device, which includes a film antenna and a cable connected to the film antenna, from causing a structure to be complicated or larger and (ii) allow the antenna device to have a more stable antenna characteristic and greater durability with respect to pulling of a cable.

Figure 1:
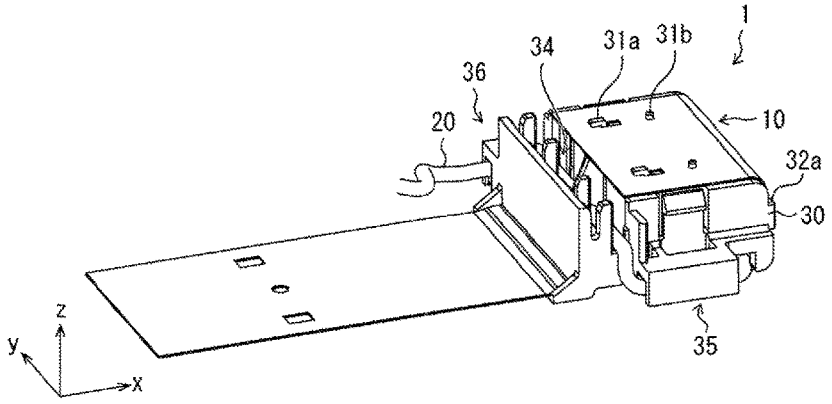
FIG. 1 is a perspective view illustrating an antenna device in accordance with Embodiment 1.
Figure 2:
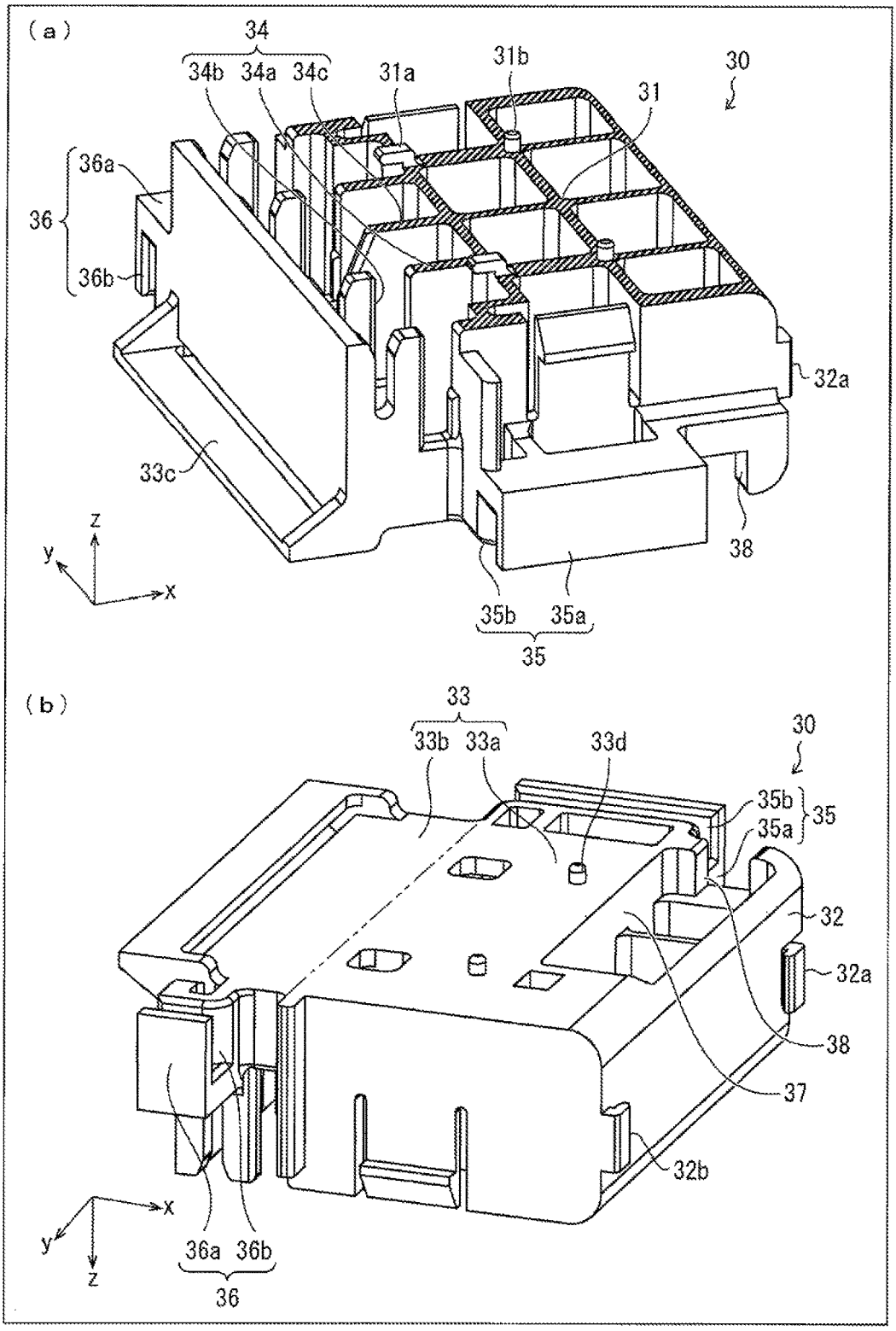

(a) and (b) of FIG. 2 are perspective views illustrating a support included in the antenna device illustrated in FIG. 1.

Figure 3:
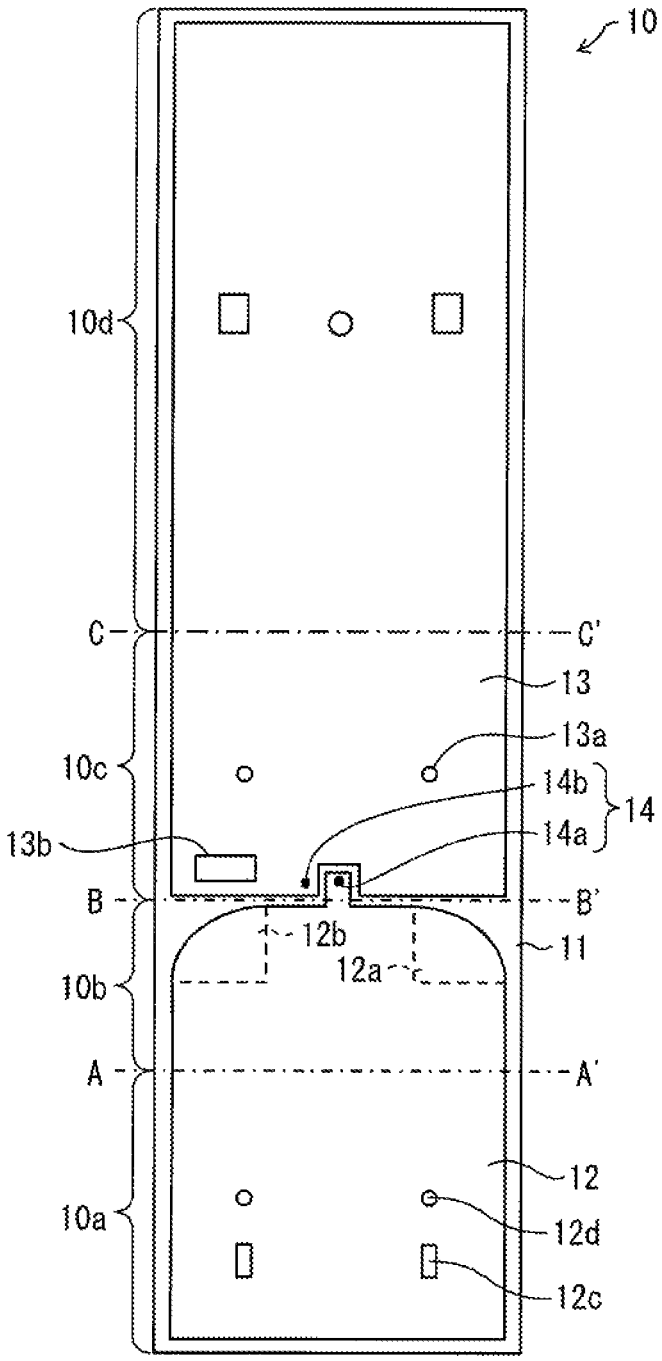

FIG. 3 is a plan view illustrating a film antenna included in the antenna device illustrated in FIG. 1.

Figure 4:
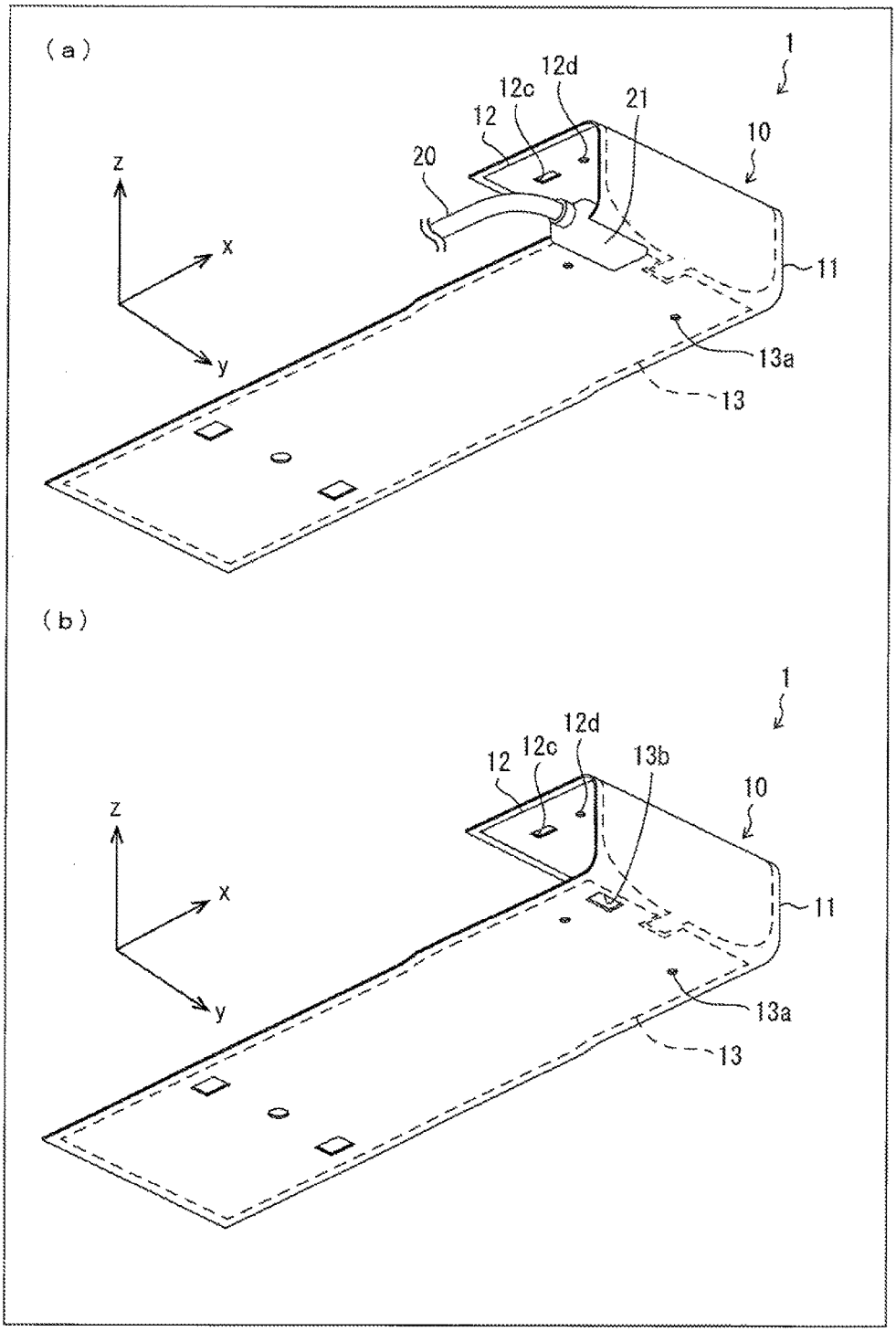

(a) of FIG. 4 is a perspective view illustrating the film antenna and a cable which are included in the antenna device illustrated in FIG. 1. (b) of FIG. 4 is a perspective view illustrating the film antenna included in the antenna device.

Figure 5:
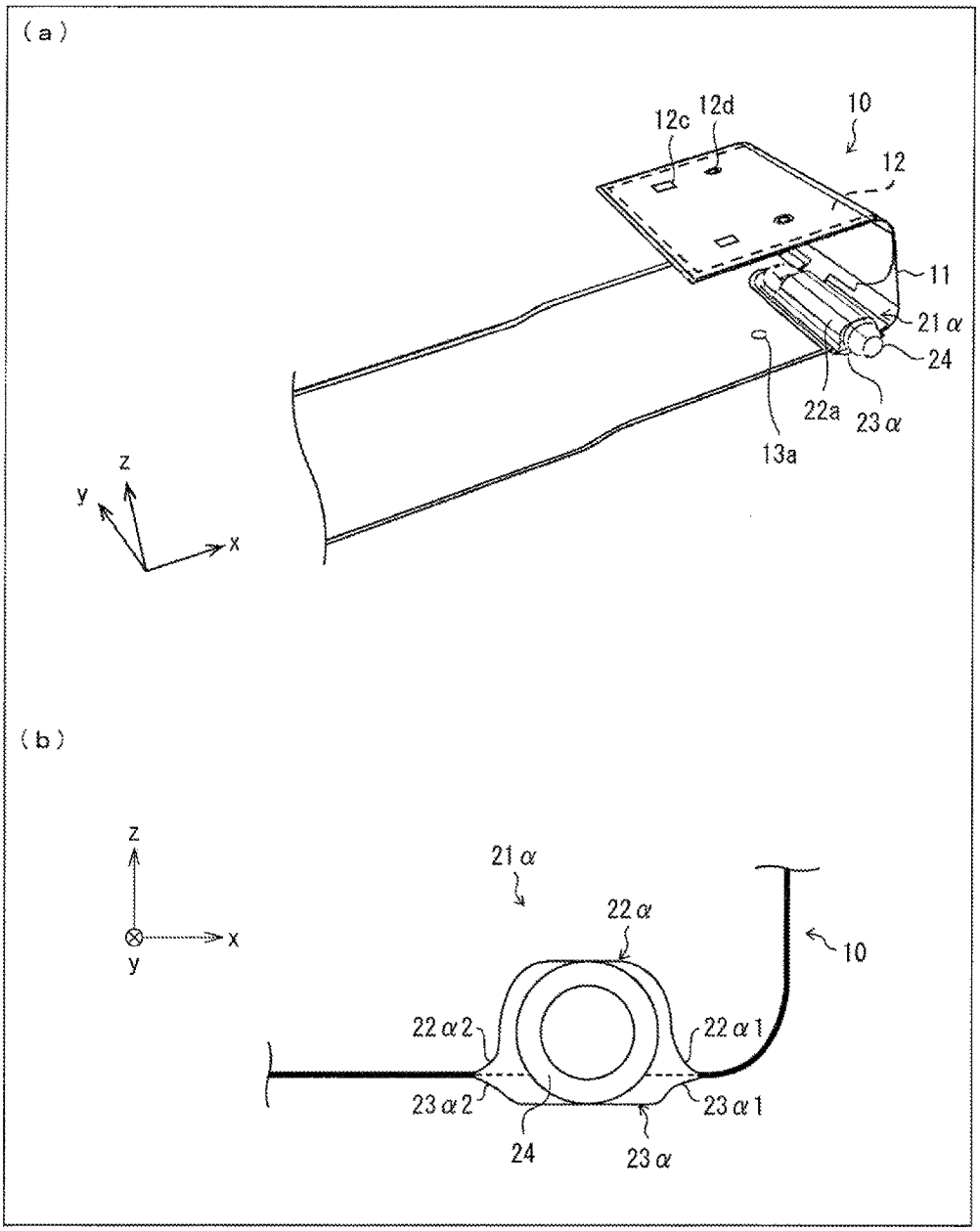

(a) of FIG. 5 is a perspective view illustrating a variation of a resin mold part included in the antenna device in accordance with Embodiment 1. (b) of FIG. 5 is a side view illustrating a left-side surface of the resin mold part illustrated in (a) of FIG. 5.

Figure 6:
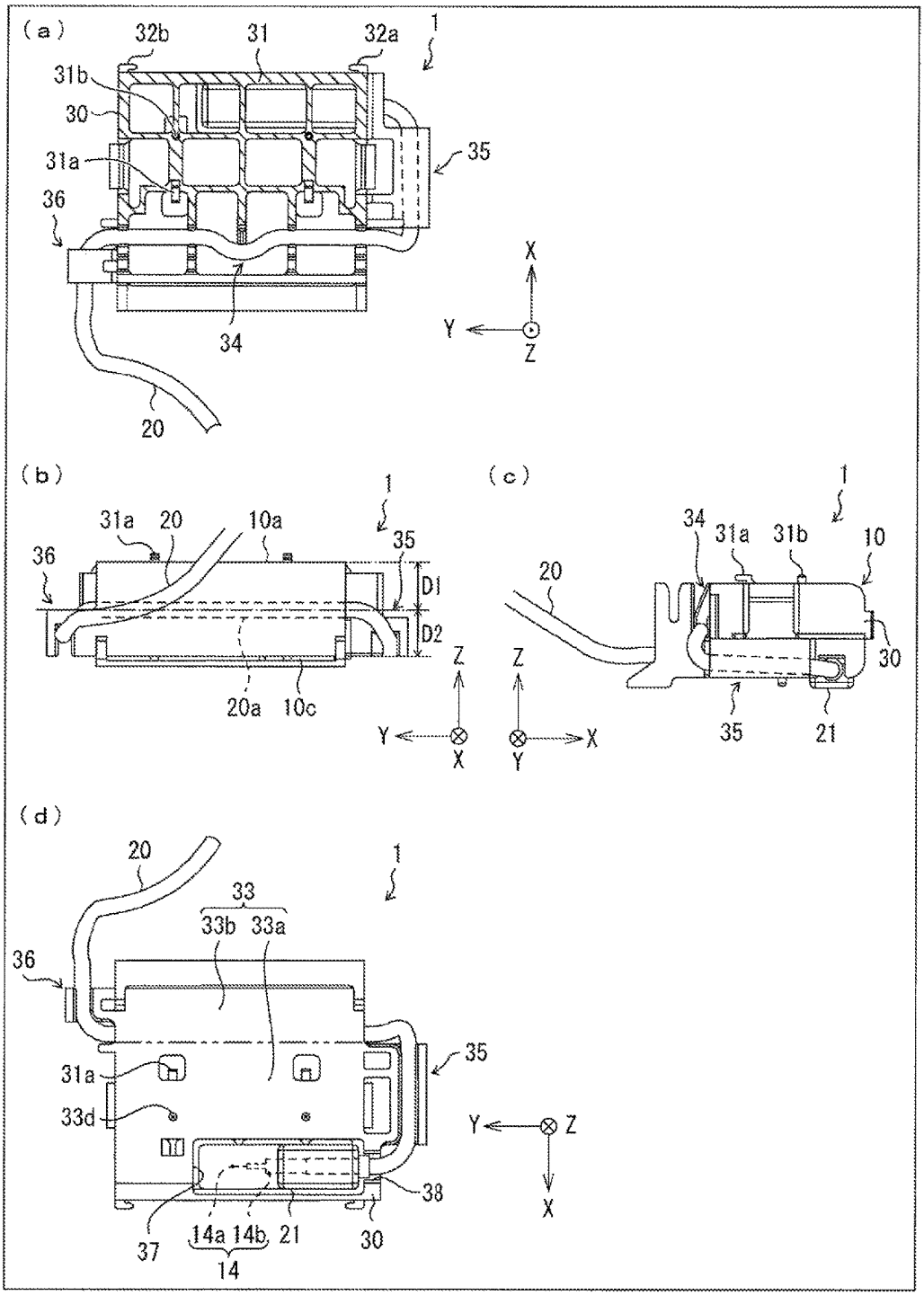

(a) through (d) of FIG. 6 are a plan view, a front view, a right side view, and a bottom view, respectively, which illustrate the antenna device illustrated in FIG. 1.

Figure 7:
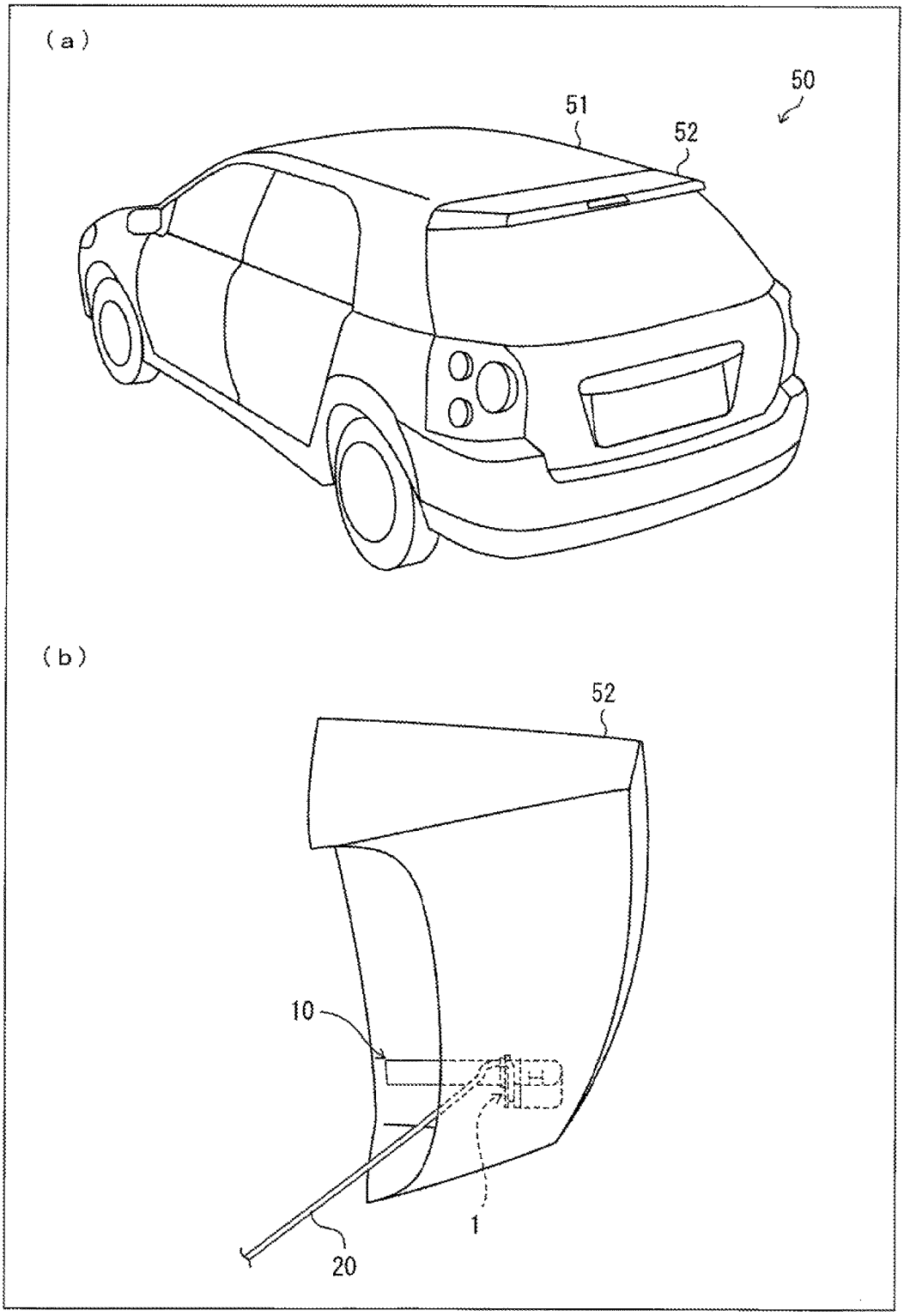

(a) of FIG. 7 is a perspective view illustrating a vehicle body on which a spoiler including an antenna device in accordance with Embodiment 2 is provided. (b) of FIG. 7 is a perspective view illustrating the spoiler.

Figure 8:
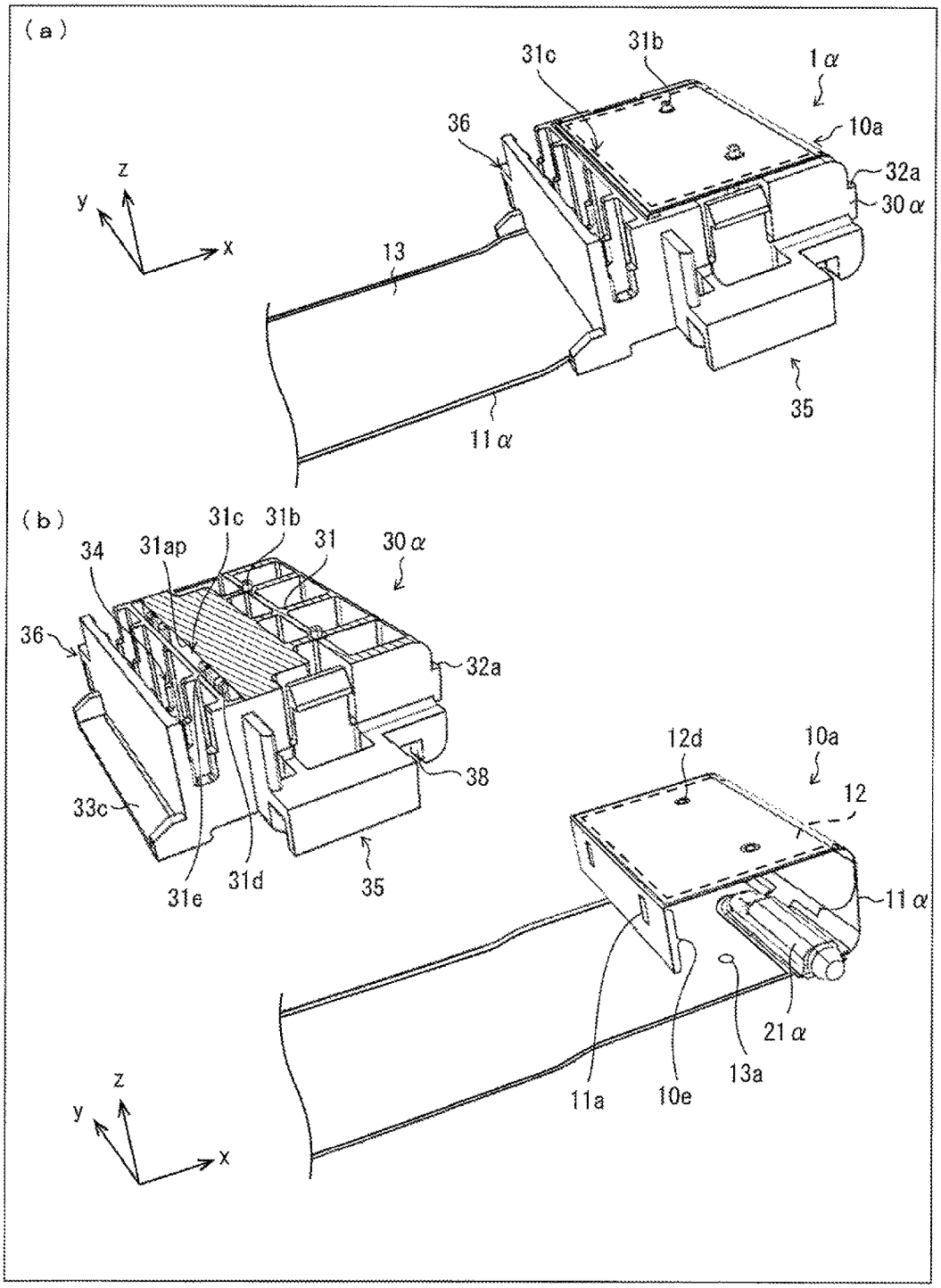

(a) of FIG. 8 is a perspective view illustrating the antenna device in accordance with Embodiment 2. (b) of FIG. 8 is an exploded perspective view illustrating the antenna device.

Figure 9:
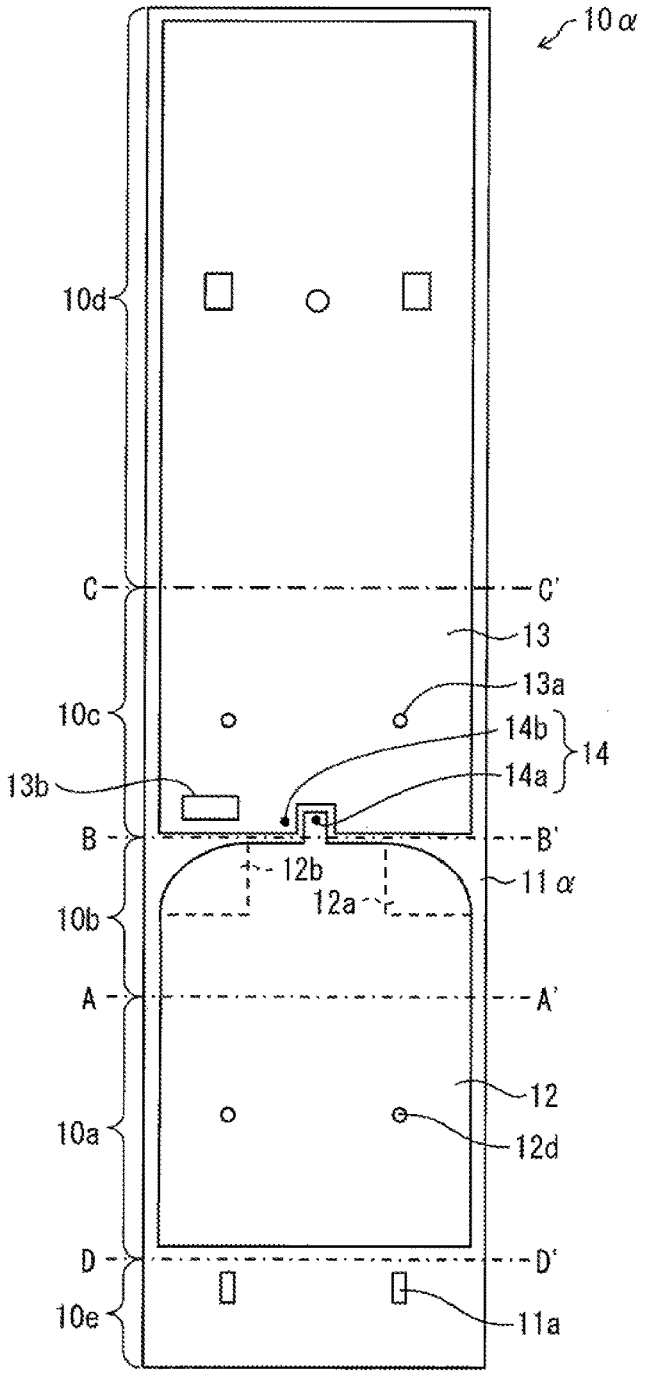

FIG. 9 is a plan view illustrating a film antenna included in the antenna device in accordance with Embodiment 2.

Figure 10:
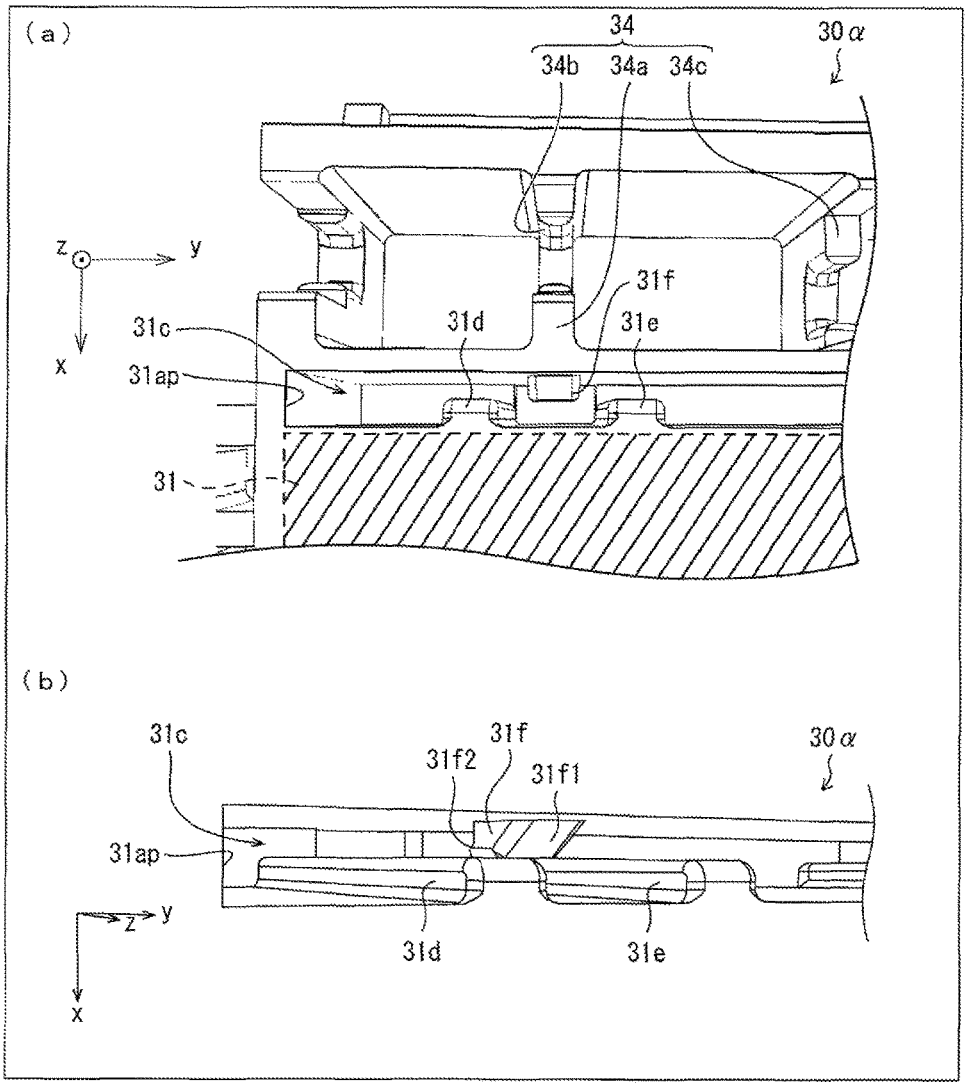

(a) of FIG. 10 is an enlarged plan view illustrating a support included in the antenna device in accordance with Embodiment 2. (b) of FIG. 10 is an enlarged perspective view illustrating the support.

Figure 11:
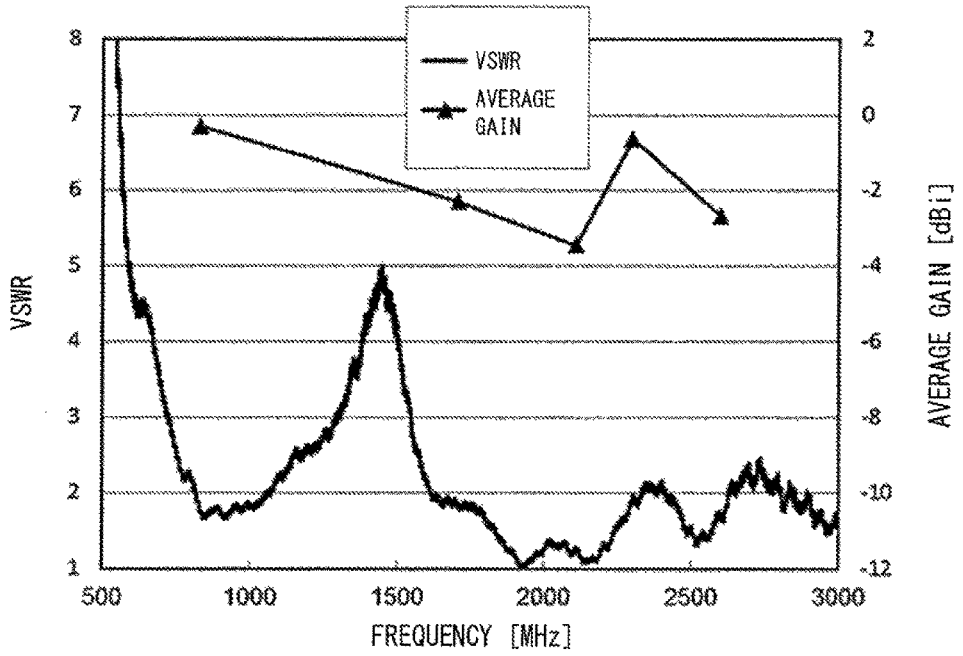

FIG. 11 is a graph showing (i) VSWR of an antenna device in accordance with Reference Example and (ii) a frequency dependency of an average gain of the antenna device in accordance with Reference Example.

Figure 12:
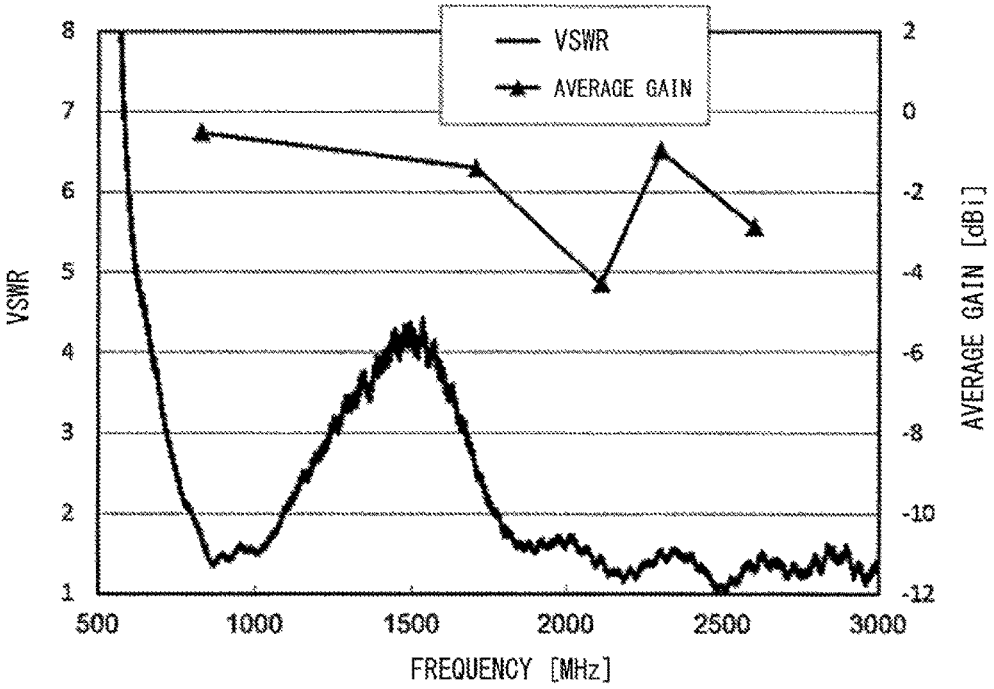

FIG. 12 is a graph showing (i) VSWR of an antenna device in accordance with Example 1 and (ii) a frequency dependency of an average gain of the antenna device in accordance with Example 1.

Figure 13:
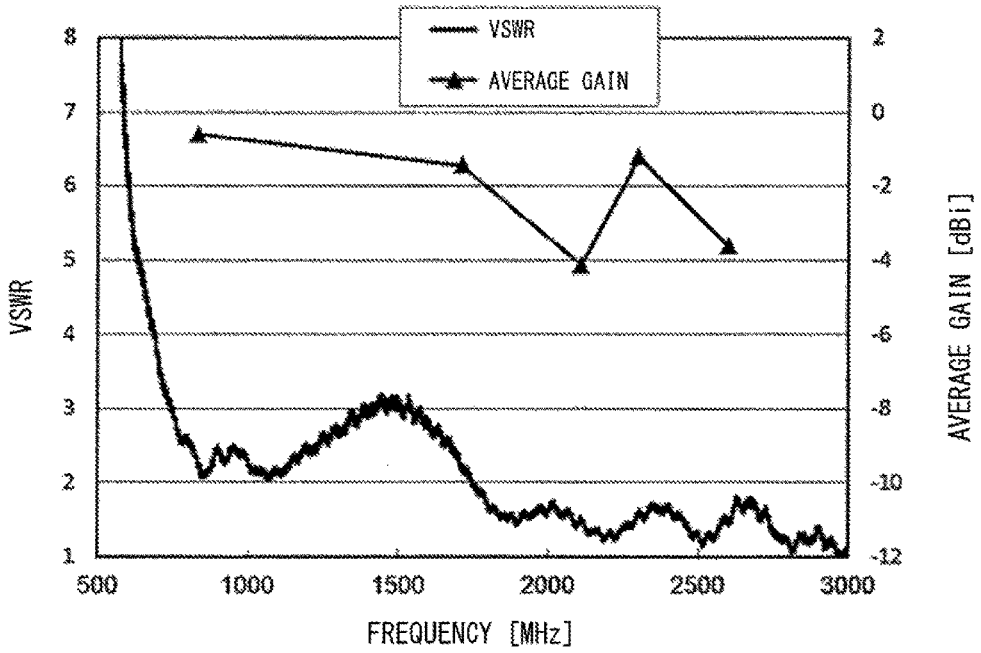

FIG. 13 is a graph showing (i) VSWR of an antenna device in accordance with Example 2 and (ii) a frequency dependency of an average gain of the antenna device in accordance with Example 2.

Figure 14:
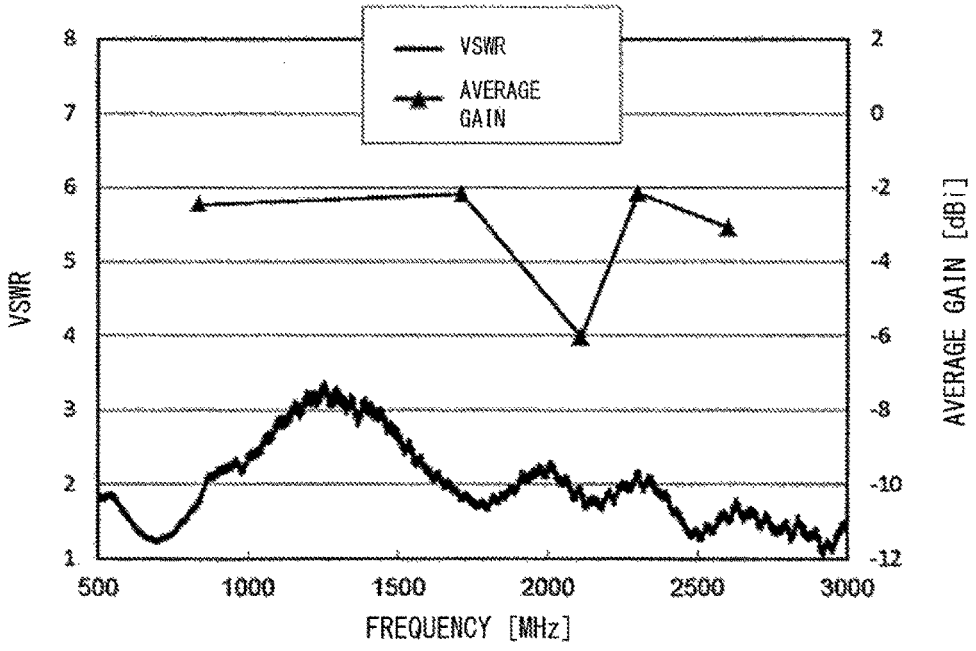

FIG. 14 is a graph showing (i) VSWR of an antenna device in accordance with Example 3 and (ii) a frequency dependency of an average gain of the antenna device in accordance with Example 3.

Figure 15:
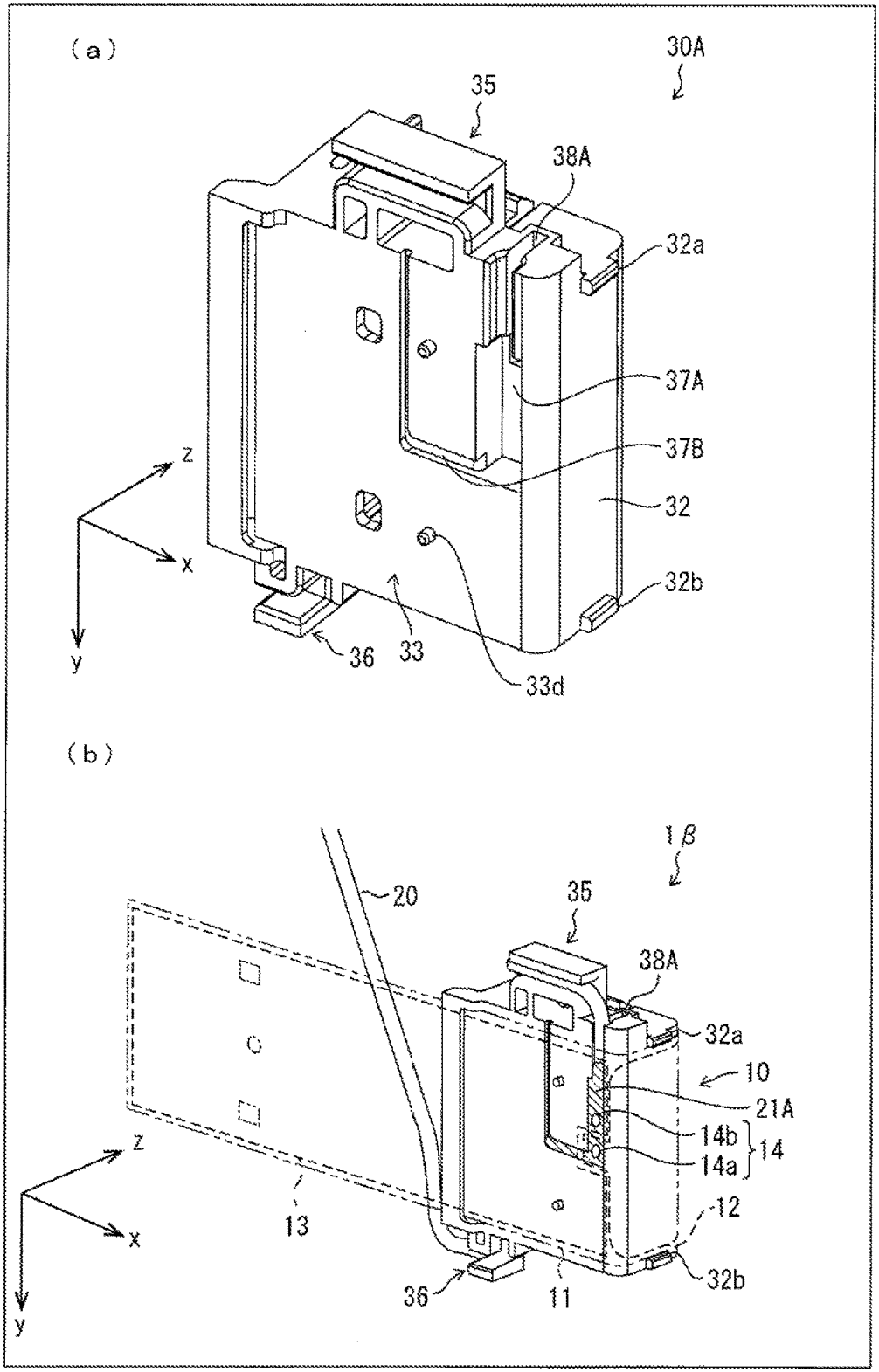

(a) of FIG. 15 is a perspective view illustrating a support included in an antenna device in accordance with Embodiment 3. (b) of FIG. 15 is a perspective view illustrating the antenna device in accordance with Embodiment 3.

Figure 16:
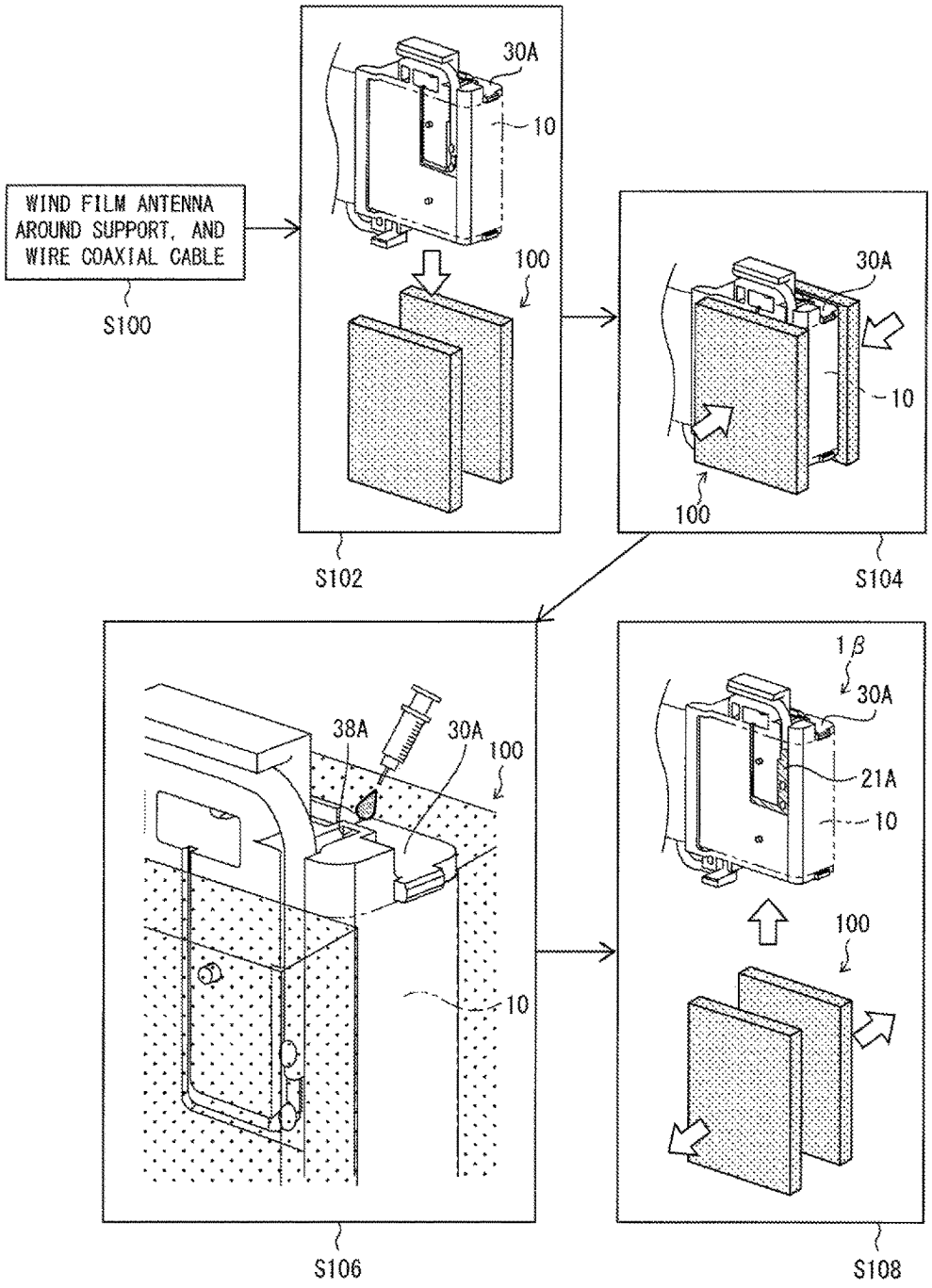

FIG. 16 is a view for describing a method of producing the antenna device in accordance with Embodiment 3.

Figure 17:
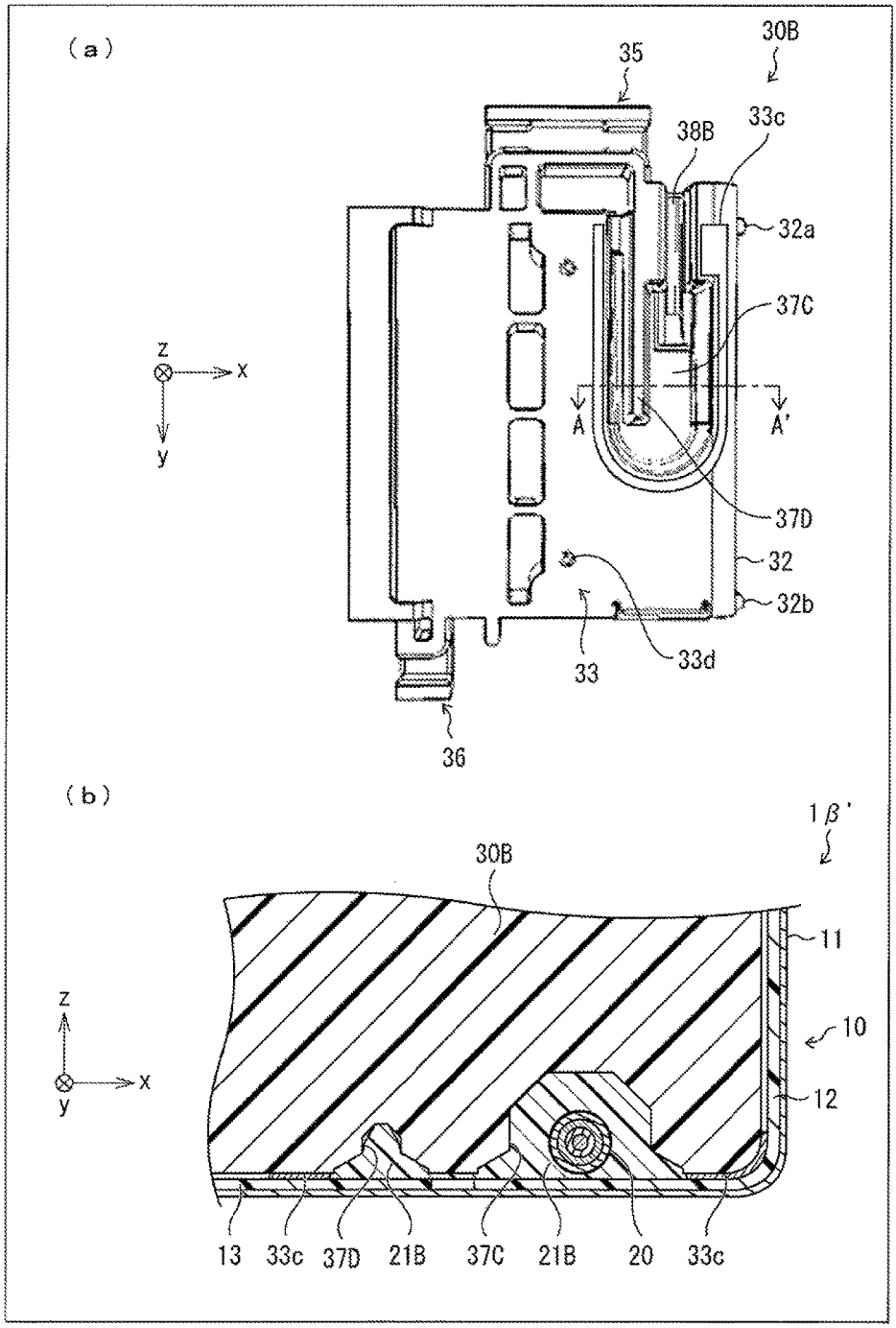

(a) of FIG. 17 is a plan view illustrating a third supporting surface of a support included in a variation of the antenna device in accordance with Embodiment 3. (b) of FIG. 17 is an enlarged cross-sectional view illustrating a variation of the antenna device in accordance with Embodiment 2.

Figure 18:
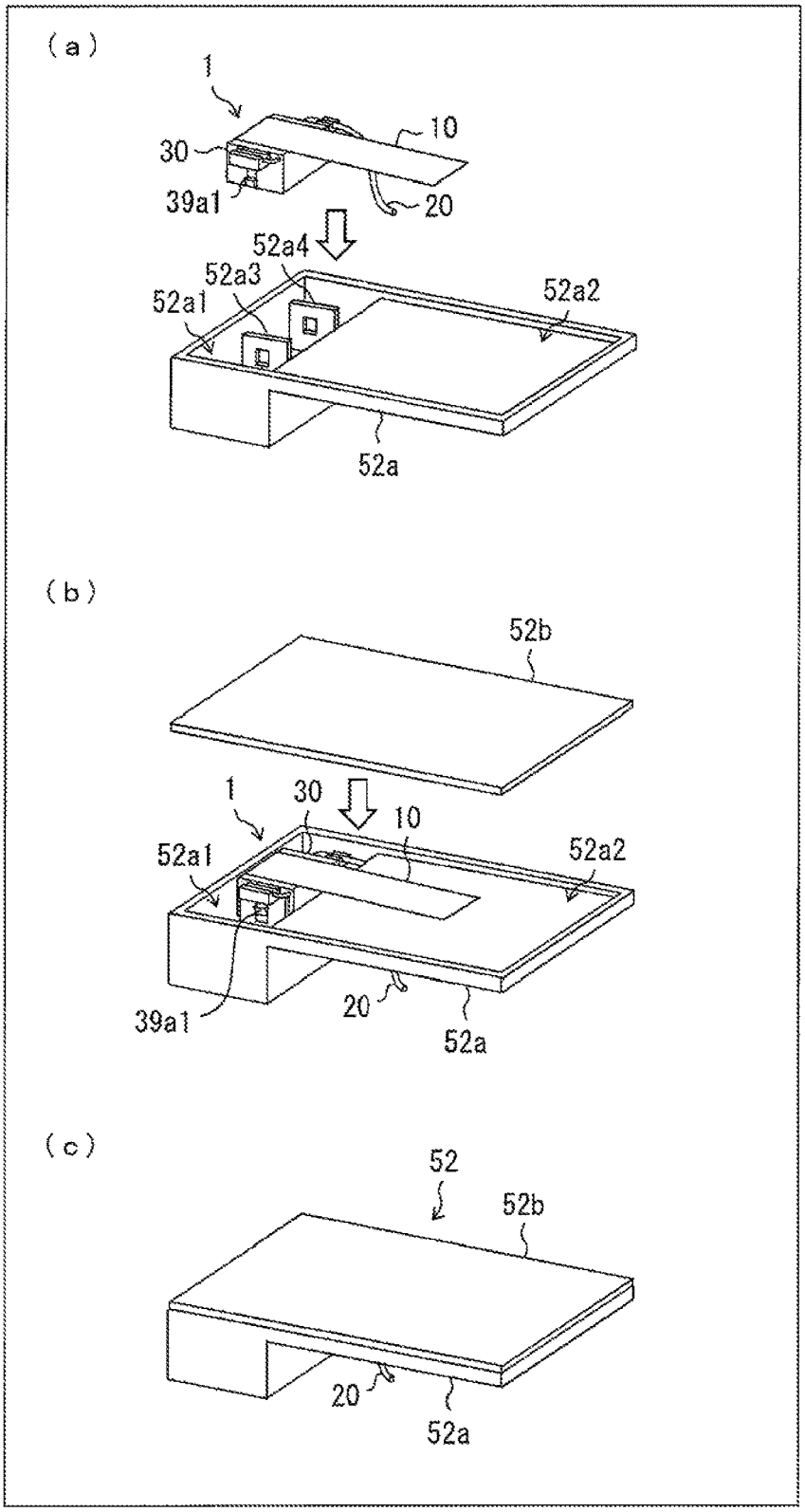

(a) through (c) of FIG. 18 are views illustrating a method of providing, in a spoiler, the antenna device illustrated in FIG. 1.

Figure 19:
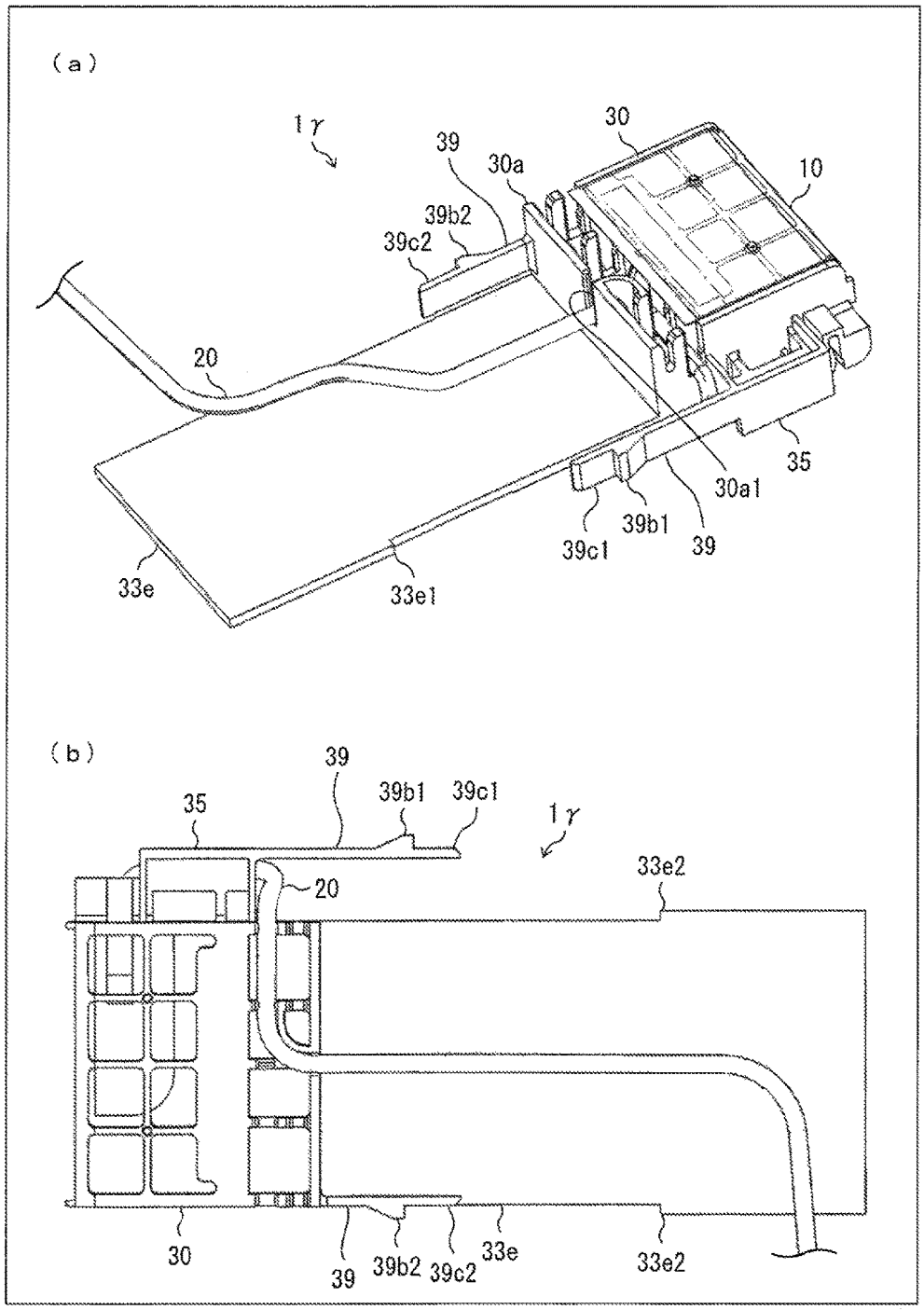

(a) and (b) of FIG. 19 is a set of a perspective view and a plan view illustrating an antenna device in accordance with Embodiment 4.

Figure 20:
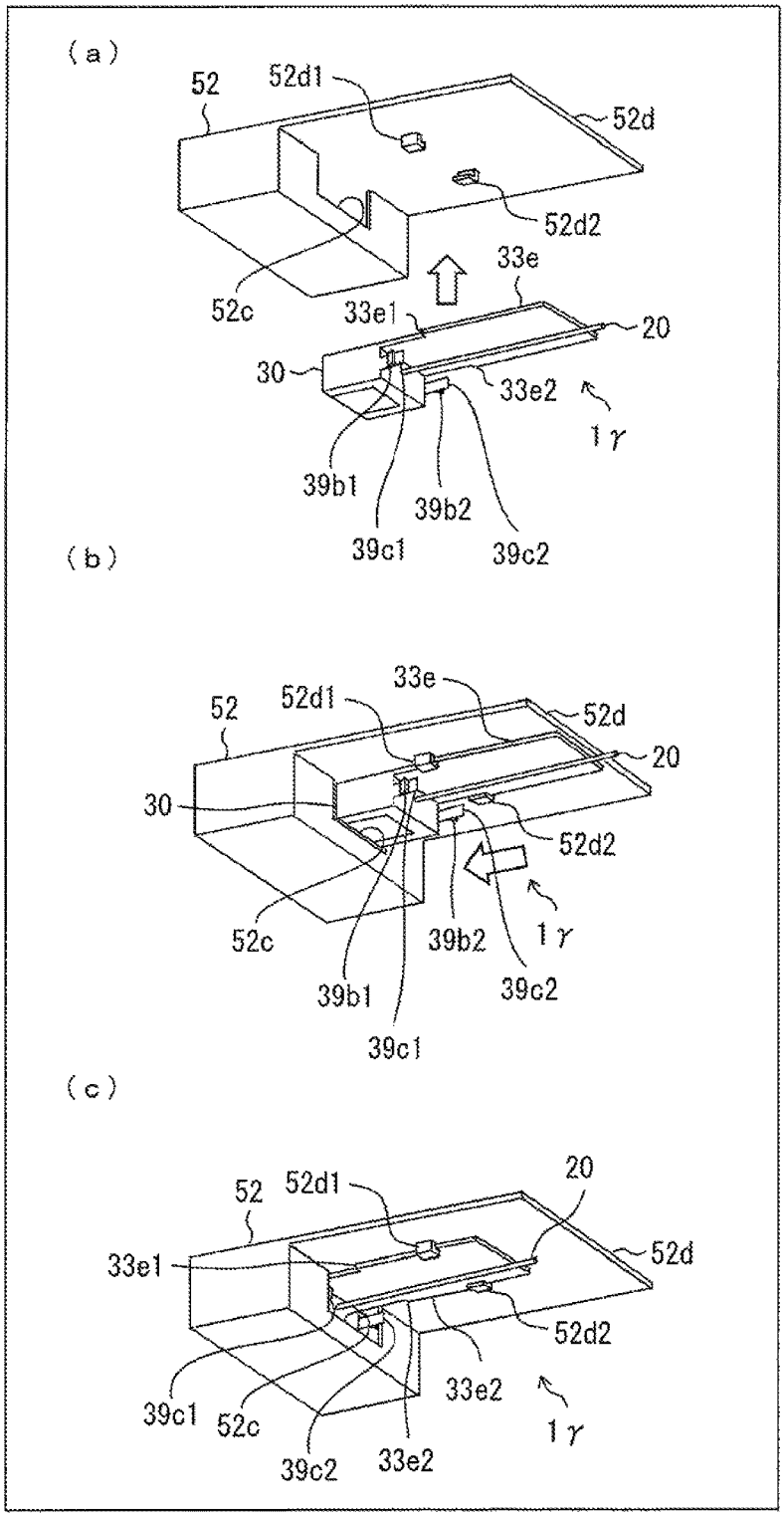

(a) through (c) of FIG. 20 are views illustrating a method of providing, in a spoiler, the antenna device illustrated in FIG. 19.

DESCRIPTION OF EMBODIMENTS

Embodiment 1

[Configuration of Antenna Device]

The following description will discuss an antenna device 1 in accordance with Embodiment 1 of the present invention with reference to FIGS. 1 through 3. FIG. 1 is a perspective view illustrating the antenna device 1. (a) of FIG. 2 is a top surface-side perspective view illustrating a support 30 included in the antenna device 1. (b) of FIG. 2 is a bottom surface-side perspective view illustrating the support 30. FIG. 3 is a plan view illustrating a film antenna 10 included in the antenna device 1.

The terms "upwards", "downwards", "rightwards", "leftwards", "frontwards", and "backwards" with respect to the antenna device are herein based on the understanding that "a z-axis positive side faces upwards", "a z-axis negative side faces downwards", "a y-axis positive side faces rightwards", "a y-axis negative side faces leftwards", "an x-axis positive side faces backwards", and "an x-axis negative side faces frontwards" in x-y-z coordinate systems in the drawings. These terms therefore do not necessarily match upward, downward, rightward, leftward, frontward, and backward orientations of the antenna device in a case where the antenna device is provided in a vehicle body or the like.

As illustrated in FIG. 1, the antenna device 1 includes the film antenna 10, a coaxial cable 20, and the support 30. The film antenna 10 is wound around the support 30 so that the film antenna 10 forms a certain three-dimensional structure. The coaxial cable 20 is connected to a feed section 14 which is made up of two connection points 14*a* and 14*b* of the film antenna 10. The coaxial cable 20 is held by the support 30 so that the coaxial cable 20 passes through a certain wiring path.

The support 30 is a structure having (i) a first supporting surface 31, (ii) a second supporting surface 32 which intersects the first supporting surface 31 (the second supporting surface 32 is orthogonal to the first supporting surface 31 in Embodiment 1), and (iii) a third supporting surface 33 which faces the first supporting surface 31 and intersects the second supporting surface 32 (the third supporting surface 33 is orthogonal to the second supporting surface 32 in Embodiment 1). The film antenna 10 is wound around the support 30 so that a front surface or a back surface of the film antenna 10 is in contact with the first supporting surface 31, the second supporting surface 32, and the third supporting surface 33.

In Embodiment 1, the support 30 is a box-shaped resin molded product as illustrated in FIG. 2. The first supporting surface 31 is a top surface of the support 30. The second supporting surface 32 is a rear-end surface (surface on the x-axis positive side in the coordinate system illustrated) of the support 30. The third supporting surface 33 is a bottom surface of the support 30. The resin molded product has lightening holes in the top surface-side. The first supporting surface 31 is constituted by top end surfaces (hatched with oblique lines in (a) of FIG. 2) of partition walls which are remaining portions other than the lightening holes. The third supporting surface 33 protrudes frontwards (i.e. toward the x-axis negative side in the coordinate system illustrated) more than does the first supporting surface 31. The third supporting surface 33 is divided into two regions which are (i) a counter region 33*a* facing a region on which the first supporting surface 31 is formed and (ii) a non-counter region 33*b* not facing the region on which the first supporting surface 31 is formed.

The support 30 includes a first holding part 34, a second holding part 35, and a third holding part 36 as a holding section for increasing durability with respect to pulling of the coaxial cable 20 by holding the coaxial cable 20 so that the coaxial cable 20 passes through a certain wiring path.

In the third supporting surface 33 of the support 30, a first recess 37 and a second recess 38 are provide. The second recess 38 is provided so as to (i) be continuous with the first recess 37 and (ii) extend toward an end part of the third supporting surface 33. The first and second recesses 37 and 38 correspond to a recessed containing part in accordance with an embodiment of the present invention. In the first and second recesses 37 and 38, a connection part via which an end part of the coaxial cable 20 and the feed section 14 are connected (hereinafter referred to as "connection part of the end part of the coaxial cable 20 and the feed section 14") is contained. The coaxial cable 20, which extends from the connection part penetrates through the first and second recesses 37 and 38. In Embodiment 1, the connection part of the end part of the coaxial cable 20 and the feed section 14 is covered with a resin mold part 21 described later (see FIG. 4).

The first recess 37 is a recess which (i) is provided at a part of the third supporting surface 33, which part is located in the vicinity of a boundary between the third supporting surface 33 and the second supporting surface 32, (ii) has a long shape extending along the boundary between the third supporting surface and the second supporting surface (i.e. extending along the y-axis in the coordinate system illustrated), and (iii) is recessed from the third supporting surface 33 toward first supporting surface 31 (i.e. toward the z-axis positive side in the coordinate system illustrated).

The first recess 37 has a size so as to contain the resin mold part 21 (which is resin molded product covering the connection part of the end part of the coaxial cable 20 and the feed section 14) described later.

The second recess 38 is a recess which (i) is narrower in width than the first recess 37, (ii) has one end part which is continuous with the first recess 37, and (iii) has the other end part which extends until the end part of the third supporting surface 33. As with the first recess 37, the second recess 38 is a recess which (i) extends along the boundary between the third supporting surface and the second supporting surface 32 (i.e. extending along the y-axis in the coordinate system illustrated) and (ii) is recessed from the third supporting surface 33 toward first supporting surface 31 (i.e. toward the z-axis positive side in the coordinate system illustrated).

The second recess 38 has a size so as to allow the coaxial cable 20, which extends from the resin mold part 21 contained in the first recess 37, to penetrate through the second recess 38.

In the antenna device 1, the film antenna 10 is (i) attached to the support 30 so that the connection part of the end part of the coaxial cable 20 and the feed section 14 is contained in the first and second recesses 37 and 38 which are provided at a part of the third supporting surface 33 which part is located in the vicinity of a boundary between the third supporting surface 33 and the second supporting surface 32 and (ii) wound around the support 30 so that the film antenna 10 is in contact with the first supporting surface 31, the second supporting surface 32, and the third supporting surface 33. In so doing, the film antenna 10 is wound around the support 30 so that (i) one end of the film antenna 10 is provided at an end part of the first supporting surface 31, which end part (edge on a first antenna conductor 12-side described later) is opposite an end part on a second supporting surface 32-side and (ii) the other end of the film antenna 10 extends out frontwards more than does an end part of the third supporting surface 33 opposite the end part of the third supporting surface 33 on the second supporting surface 32-side.

The first holding part 34 is provided in a region protruding frontwards more than does the end part of the first supporting surface 31, which end part is opposite the end part on the second supporting surface 32-side. Specifically, the first holding part 34 is provided on a top surface-side (toward the z-axis positive side in the coordinate system illustrated) of the non-counter region 33*b* of the third supporting surface 33. The first holding part 34 holds part of the coaxial cable 20 so that the part extends in a direction along (parallel to, in Embodiment 1) both the first supporting surface 31 and the second supporting surface 32 (i.e. along the y-axis in the coordinate system illustrated). The first holding part 34 provided outside of a spatial region which is sandwiched between (i) a region of the film antenna 10 which region is in contact with the first supporting surface 31 and (ii) a region of the film antenna 10 which region is in contact with the third supporting surface 33. This allows the coaxial cable 20 to be placed in the first holding part 34 even after the film antenna 10 is wound around the support 30.

In Embodiment 1, the holding part 34 includes (i) a plurality of (4 in Embodiment 1) partition walls 34*a* which are provided so that respective wall surfaces of the partition walls 34*a* are perpendicular to both the third supporting surface 33 and the second supporting surface 32 and (ii) recesses 34*b* (slits) which are provided in the respective partition walls 34*a* and which have respective openings facing upwards. By fitting the coaxial cable 20 into the recesses 34*b* of the partition walls 34*a*, the coaxial cable 20 is held (sandwiched) successfully as described above. In order to cause the coaxial cable 20, which is held by the first holding part 34, to meander and to be unlikely to come off from the first holding part 34, a partition wall 34*c* is used in Embodiment 1. The partition wall 34*c* is provided so that a wall surface of the partition wall 34*c* extends parallel to the wall surfaces of the partition walls 34*a*. A front end surface of the partition wall 34*c* is inclined so that a lower part of the front end surface further juts out frontwards than does an upper part of the front end surface. Therefore, in a case where the coaxial cable 20 is deeply fitted into the recesses 34*b* of the partition walls 34*a*, a center part of the coaxial cable 20 is pushed out frontwards by the partition wall 34*c*, so that the coaxial cable 20 meanders and is pressed against the partition walls 34*a* more firmly. This causes force of friction occurring between the coaxial cable 20 and the partition walls 34*a* to be greater, and therefore causes the coaxial cable 20 to be unlikely to come off.

The second holding part 35 is provided on a left-side surface (surface facing the y-axis negative direction in the coordinate system illustrated) of the support 30. The second holding part 35 holds part of the coaxial cable 20 so that the part extends perpendicularly to the second supporting surface 32 (i.e. extends along the x-axis in the coordinate system illustrated). The second holding part 35 serves to guide the coaxial cable 20 as follows: The coaxial cable 20 extends from the resin mold part 21 contained in the recessed containing part (the first and second recesses 37 and 38) provided at a part of the third supporting surface 33 which part is located in the vicinity of a boundary between the third supporting surface 33 and the second supporting surface 32. The coaxial cable 20 is then held by the second holding part 35 so that the coaxial cable 20 is (i) bent and guided frontwards (toward an end part opposite an end part on the second supporting surface 32-side) and (ii) guided to the first holding part 34.

The second holding part 35 is provided outside of the spatial region which is sandwiched between (i) the region of the film antenna 10 which region is in contact with the first supporting surface 31 and (ii) the region of the film antenna 10 which region is in contact with the third supporting surface 33. This allows the coaxial cable 20 to be placed in the second holding part 35 even after the film antenna 10 is wound around the support 30.

In Embodiment 1, a protruding part 35*a*, which serves as the second holding part 35, has a rectangular parallelepiped shape and protrudes leftwards from a lower end part of the left-side surface of the support 30. The protruding part 35*a* has a recess 35*b* having an opening which faces downwards and which extend from an end surface on the second supporting surface 32-side to an opposite end surface. By fitting the coaxial cable 20 into the recess 35*b*, the coaxial cable 20 is successfully held as described above.

The third holding part 36 is provided on a right-side surface (surface facing the y-axis positive direction in the coordinate system illustrated) of the support 30. The third holding part 36 holds part of the coaxial cable 20 so that the part extends perpendicularly to the second supporting surface 32 (i.e. extends along the x-axis in the coordinate system illustrated). Then, the third holding part 36 bends the coaxial cable 20, which extends out from the first holding part 34, and guides the coaxial cable 20 frontwards. The third holding part 36 is provided outside of the spatial region which is sandwiched between (i) the region of the film antenna 10 which region is in contact with the first supporting surface 31 and (ii) the region of the film antenna 10 which region is in contact with the third supporting surface 33. This allows the coaxial cable 20 to be placed in the third holding part 36 even after the film antenna 10 is wound around the support 30.

In Embodiment 1, the third holding part 36 is a protruding part 36*a* having a rectangular parallelepiped shape and protruding rightwards from a lower end part of the right-side surface of the support 30. The protruding part 36*a* has a recess 36*b* having an opening which faces downwards and which extend from an end surface on the second supporting surface 32-side to an opposite end surface. By fitting the coaxial cable 20 into the recess 36*b*, the coaxial cable 20 is successfully held as described above.

In Embodiment 1, the third supporting surface 33 of the support 30 thus has the first and second recesses 37 and 38 for containing the connection part of the end part of the coaxial cable 20 and the feed section 14 (part covered with the resin mold part 21) when the film antenna 10 is wound around the support 30. Then, the first holding part 34 for holding the coaxial cable 20 is provided on the surface (first supporting surface 31-side) opposite the third supporting surface 33. The support 30 also includes two holding parts (the second and third holding parts 35 and 36). The second and third holding parts 35 and 36 have the recess 35*b* and the recess 36*b*, respectively, each of which has an opening on the side opposite the surface on which the first holding part 34 is provided. The second holding part 35 and the third holding part 36 are provided on the left-side surface and the right-side surface, respectively, of the support 30.

On the first supporting surface 31 (specifically the top end surface of the partition walls constituting the first supporting surface 31), L-shaped protrusions 31*a* and I-shaped protrusions 31*b* are provided. The L-shaped protrusions 31*a* are each made up of (i) a first columnar part extending upwards from the first supporting surface 31 and (ii) a second columnar part extending frontwards from an upper end part of the first columnar part. Rectangular openings 12*c*, which are made in the film antenna 10 (see FIG. 3), are to be hooked to the corresponding L-shaped protrusions 31*a* so that (i) the film antenna 10 is positioned relative to the support 30 and (ii) the film antenna 10 is prevented from being detached from the support 30 even if part of the film antenna 10, which part is in contact with the first supporting surface 31, is pulled backwards (even if part of the film antenna 10, which part is contact with the third supporting surface 33, is pulled frontwards). Meanwhile, the I-shaped protrusions 31*b* are each a columnar part extending upwards from the first supporting surface 31. The I-shaped protrusions 31*b* are to be engaged with circular openings 12*d* (see FIG. 3) made in the film antenna 10 so that the film antenna 10 is positioned relative to the support 30.

As illustrated in (b) of FIG. 2, in a case where the support 30 is provided so that the z-axis positive side faces downwards in the drawing, an L-shaped guide 32*a* is provided at a right end part of the second supporting surface 32. The L-shaped guide 32*a* is made up of (i) a first plate-like part extending backwards from the second supporting surface 32 and (ii) a second plate-like part extending rightwards from a back end part of the first plate-like part. Likewise, an L-shaped guide 32*b* is provided at a left end part of the second supporting surface 32 (see (b) of FIG. 2). The L-shaped guide 32*b* is made up of (i) a first plate-like part extending backwards from the second supporting surface 32 and (ii) a second plate-like part extending leftwards from a back end part of the first plate-like part. The film antenna 10 can be made to come into close contact with the second supporting surface 31 by (i) sandwiching an right end part of the film antenna 10 between the second plate-like part of the L-shaped guide 32*a* and the second supporting surface 32 and (ii) sandwiching a left end part of the film antenna 10 between the second plate-like part of the L-shaped guide 32*b* and the second supporting surface 32.

The third supporting surface 33 has I-shaped protrusions 33*d*. The I-shaped protrusions 33*d* are each a columnar part extending downwards from the third supporting surface 33. The I-shaped protrusions 33*d* are to be engaged with circular openings 13*a* provided on the film antenna 10 (see FIG. 3) so that the film antenna 10 is positioned relative to the support 30. At a front end part of the third supporting surface 33, a guide ring 33*c* is provided (see (a) of FIG. 2). The film antenna 10 is to pass through the guide ring 33*c*, so that the film antenna 10 can be supported so as to be guided along the third supporting surface 33. In other words, the film antenna 10 passes through the guide ring 33*c* as well as is supported by the guide ring 33*c*.

Note that examples of a material for the support 30 encompass a PC-ABS resin obtained by mixing a polycarbonate resin (PC resin) and an acrylonitrile-butadiene-styrene copolymerized synthetic resin (ABS resin). However, the present invention is not limited to such a material.

[Film Antenna 10]

As illustrated in FIG. 3, the film antenna 10 includes (i) a dielectric film 11 and (ii) a pair of antenna conductors 12 and 13 provided as a pattern on a surface of the dielectric film 11.

The first antenna conductor 12 includes a first connection point 14*a* to which an inner conductor (hot side conductor) of the coaxial cable 20 is connected. Meanwhile, the second antenna conductor 13 includes a second connection point 14*b* to which an outer conductor (cold side conductor) of the coaxial cable 20 is connected. The feed section 14 of the film antenna 10 is made up of the first connection point 14*a* and the second connection point 14*b*. Although not illustrated, the end part of the coaxial cable 20 is connected to the feed section 14 (the first and second connection points 14*a* and 14*b*) of the film antenna 10. Specifically, the inner conductor of the coaxial cable 20 is connected to the first connection point 14*a* by soldering. The outer conductor of the coaxial cable 20 is connected to the second connection point 14*b* by soldering.

The first antenna conductor 12 and the second antenna conductor 13 constitute (i) a dipole antenna in which the first antenna conductor 12 and the second antenna conductor 13 each serve as an antenna element or (ii) a monopole antenna in which the first antenna conductor 12 and the second antenna conductor 13 serve as an antenna element and a ground plane, respectively.

In Embodiment 1, the first antenna conductor 12 is a conductive foil (e.g. copper foil) having a bell-like shape obtained by replacing, with quartered ellipses 12*a* and 12*b*, two corners that are adjacent via a shorter side of a rectangle. At the side thus sandwiched between the quartered ellipses 12*a* and 12*b* of the first antenna conductor 12, a protrusion is provided. The first connection point 14*a* is provided on the protrusion. In Embodiment 1, the second antenna conductor 13 is a conductive foil (e.g. copper foil) having a rectangular shape. At a shorter side of the second antenna conductor 13, a recess is provided. The second connection point 14*b* is provided in the vicinity of the recess. The first antenna conductor 12 and the second antenna conductor 13 are combined so that (i) the protrusion is inserted into the recess and (ii) the first connection point 14*a* and the second connection point 14*b* face each other via a gap between the first antenna conductor 12 and the second antenna conductor 13.

Note that at an end part of the second antenna conductor 13 which part is located in the proximity of the first antenna conductor 12, an opening 13*b* is provided for increasing bonding strength with which the resin mold part 21 (described later) and the film antenna 10 are bonded. Assume a case where the resin mold part 21, which covers the feed section 14 of the film antenna 10 and covers the end part of the coaxial cable connected to the feed section 14, is provided in a region including the opening 13*b*. In such a case, a resin material, by which the resin mold part 21 is formed, spreads over the front surface and the back surface of the film antenna 10 via the opening 13. This allows bonding strength, with which the resin mold part 21 and the film antenna 10 are bonded, to be increased.

The film antenna 10 is wound around the support 30 by folding the film antenna 10 in a U shape whose ridgelines are (i) a line A-A' which extends across the first antenna conductor 12 and (ii) a line B-B' which extends between the first antenna conductor 12 and the second antenna conductor 13. That is, on the film antenna 10 wound around the support 30, the following bent parts are made: (i) a bent part which is bent at the line A-A' along a boundary between the first and second supporting surfaces 31 and 32 of the support 30 and (ii) a bent part which is bent at the line B-B' along a boundary between the second and third supporting surfaces 32 and 33.

In so doing, (i) a region 10*a* (first region: main part of the first antenna conductor 12), which expands between the edge on the first antenna conductor 12-side and the line A-A', comes into contact with the first supporting surface 31 of the support 30, (ii) a region 10*b* (second region), which expands between the line A-A' and the line B-B', comes into contact with the second supporting surface 32 of the support 30, and (iii) a region 10*c* (third region: main part of the second antenna conductor 13), which expands between the line B-B' and a line C-C' that extends across the second antenna conductor 13), comes into contact with the third supporting surface 33 of the support 30. Note that a region 10*d*, which expands between the line C-C' and an edge on a second antenna conductor 13-side, does not come into contact with any surface of the support 30.

Note that examples of a material for the dielectric film 11 encompass polyimide. Examples of a material for each of the pair of antenna conductors 12 and 13 encompass copper. The film antenna 10 is preferably highly flexible so as to (i) fit the film antenna 10, which is folded, to each of the first through third supporting surfaces 31 through 33 of the support 30 and (ii) prevent a gap between the film antenna 10 and the support 30 from occurring. Therefore, the dielectric film 11, the first antenna conductor 12, and the second antenna conductor 13 are each preferably thin in thickness. For example, it is possible that (1) the antenna conductors 12 and 13 are each a copper foil having a thickness of 20 μm and (2) the dielectric film 11 is a polyimide film which has one surface coated with an adhesive and which has a total thickness of 35 μm including the thickness of the adhesive.

The film antenna 10 can further include a dielectric film which covers the front surfaces of the antenna conductors 12 and 13. That is, the film antenna 10 can be configured so that the antenna conductors 12 and 13 are sandwiched between two dielectric films. In a case where both surfaces of each of the antenna conductors 12 and 13 are covered with the dielectric films, it is possible to prevent the occurrence of damage to and deterioration of the antenna conductors 12 and 13.

[Resin Mold Part 21]

The resin mold part 21, which covers (i) the feed section 14 of the film antenna 10 and (ii) the end part of the coaxial cable connected to the feed section 14, will be described next with reference to FIG. 4. (a) of FIG. 4 is a perspective view illustrating the antenna device 1. The support 30 is omitted from (a) of FIG. 4. (b) of FIG. 4 is a perspective view illustrating the film antenna 10 included in the antenna device 1 illustrated in (a) of FIG. 4.

As illustrated in (a) of FIG. 4, the inner conductor and the outer conductor of the coaxial cable 20 and the resin mold part 21 (which covers the feed section 14 without a gap) are provided (i) at the connection part of the end part of the coaxial cable 20 and the feed section 14 and (ii) in the vicinity of the connection part. The resin mold part 21 is formed by a resin molded product. This prevents the inner conductor and the outer conductor of the coaxial cable 20 and the feed section 14 from being exposed. Therefore, the resin mold part 21 allows the connection part of the coaxial cable 20 and the feed section 14 to be waterproof. This prevents soldering of the feed section 14 from deteriorating due to moisture in an atmosphere or the like, and consequently increases a water-resistant property of the film antenna 10.

As illustrated in (b) of FIG. 4, the second antenna conductor 13 has the opening 13*b*. This causes, during forming of the resin mold part 21, a resin material by which the resin mold part 21 is formed spreads over the front surface and the back surface of the film antenna 10 via the opening 13*b*. As a result, the resin mold part 21 sandwiches the film antenna 10 from the front surface-side and the back surface-side, so that a resin is continuously formed via the opening 13*b*. This allows bonding strength, with which the resin mold part 21 and the film antenna 10 are bonded, to be increased, so that the resin mold part 21 can be prevented from peeling from the film antenna 10.

[Variation of Resin Mold Part]

A resin mold part 21α, which is a variation of the resin mold part 21, will be described below with reference to FIG. 5. (a) of FIG. 5 is a perspective view illustrating an antenna device 1 including the resin mold part 21α. (b) of FIG. 5 is a right side view illustrating the resin mold part 21α (side view obtained when resin mold part 21α is viewed from y-axis negative side in the coordinate system illustrated). Note that a support 30 and part (cable part) of a coaxial cable 20 other than the resin mold part 21α are omitted from (b) of FIG. 5.

As illustrated in (a) and (b) of FIG. 5, the resin mold part 21α includes a first covering part 22α, a second covering part 23α, and a third covering part 24. The first covering part 22α is provided on a front surface (surface facing the z-axis positive side in the coordinate system illustrated) of the film antenna 10. The second covering part 23α is provided on a back surface (surface facing the z-axis negative side in the coordinate system illustrated) of the film antenna 10. The third covering part 24 is provided at an end part toward which the cable part of the coaxial cable 20 is drawn.

When the film antenna 10 is viewed from a direction perpendicular to a third region 10*c* (i.e. viewed along the z-axis in the coordinate system illustrated), a region in which the first covering part 22α is in contact with the front surface of the film antenna 10 is identical to a region in which the second covering part 23α is in contact with the back surface of the film antenna 10.

The first covering part 22α is configured so as to gradually become thinner in thickness (height as measured from the front surface of the film antenna 10) from a part corresponding to a center part of the coaxial cable 20 to a part corresponding a line B-B'. In other words, the first covering part 22α gradually becomes thinner toward a bent part at which the film antenna 10 is bent between the third region 10*c* and a second region 10*b*. This part of the first covering part 22α, which part gradually becomes thinner in thickness will be referred to as "skirt part 22α1" of the first covering part 22α. The skirt part 22α1 includes, of edges of the first covering part 22α, an edge extending along the line B-B' (i.e. the edge that is closer to the line B-B').

Likewise, the second covering part 23α is configured so as to gradually become thinner in thickness (height as measured from the front surface of the film antenna 10) from a part corresponding to the center part of the coaxial cable 20 to a part corresponding to the line B-B'. In other words, the second covering part 23α gradually becomes thinner toward the bent part at which the film antenna 10 is bent between the third region 10*c* and the second region 10*b*. This part of the second covering part 23α, which part gradually becomes thinner in thickness will be referred to as "skirt part 23α1" of the second covering part 23α. The skirt part 23α1 includes, of edges of the second covering part 23α, an edge extending along the line B-B' (i.e. the edge that is close to the line B-B').

The resin mold part 21α is configured so that the skirt part 22α1 of the first covering part 22α and the skirt part 23α1 of the second covering part 23α are located on a front side and a back side, respectively, of a shared region so as to face each other. Therefore, in a case where the film antenna 10 is folded at the line B-B' as a ridgeline, stress derived from the folding can be distributed to the skirt part 22α1 of the first covering part 22α and to the skirt part 23α1 of the second covering part 23α.

In addition, each of the skirt parts 22α1 and 23α1 thus gradually becomes thinner in thickness toward the line B-B'. Therefore, in a case where the film antenna 10 is folded, the first covering part 22α and the second covering part 23α are each more bendable toward the line B-B' in response to force applied along the z-axis. Therefore, stress derived from folding of the film antenna 10 does not become concentrated on the edges of the first covering part 22α and the second covering part 23α along the line B-B', but is gradually reduced on the skirt parts 22α1 and 23α1 as distancing from the line B-B'.

With these configurations, the following is true: Even if the film antenna 10 is folded in the vicinity of the resin mold part 21α, it is possible to (i) prevent the edge of the first covering part 22α in the vicinity of the line B-B' and the film antenna 10 from peeling from each other over a long period of time and (ii) prevent the edge of the second covering part 23α in the vicinity of the line B-B' and the film antenna 10 from peeling from each other over a long period of time. This allows a water-resistant property of the antenna device 10 to be maintained at a high level over a long period of time.

In particular, in a case where the resin mold part 21α is formed by injection molding in which a resin molding die is used as described later in the "production method" section, (i) a resin mold part forming step is carried out in which the resin mold part 21α is subjected to injection molding while the film antenna 10 is spread out flat and then (ii) a winding step is carried out in which the film antenna 10 is wound around the support 30. The resin mold part 21α is provided along the shape of the film antenna 10 that is spread out. Therefore, in the winding step, a large level of stress is applied to, of all the edges of the first covering part 22α and second covering part 23α, the edges extending along the line B-B'. The resin mold part 22α including the skirt parts 22α1 and 23α1 is suitable as a resin mold part to be formed by injection molding with the use of such a die. The resin mold part 21α is also suitable in a case where the resin mold part 21α is made of a resin material having a high degree of hardness.

Note that the first covering part 22α and second covering part 23α are configured so as to gradually become thinner in thickness from the parts corresponding to the center part of the coaxial cable 20 to parts corresponding to a line C-C'. These parts, which gradually become thinner in thickness, will be referred to as "skirt parts 22α2 and 23α2" of the first covering part 22α and second covering part 23α, respectively. The second antenna conductor 13 is configured not to be folded. Therefore, although the skirt parts 22α2 and 23α2 do not serve an active role in increasing the water-resistant property of the antenna device 10, the skirt parts 22α2 and 23α2 bring about the effect of improving an appearance of the resin mold part 21α. The first covering part 22α and second covering part 23α can thus include the skirt parts 22α2 and 23α2, respectively.

[Wiring Path of Coaxial Cable]

The wiring path of the coaxial cable 20 included in the antenna device 1 will be described below with reference to FIG. 6. (a), (b), and (d) of FIG. 6 are a plan view, a front view, and a bottom view, respectively, which illustrate the antenna device 1. (c) of FIG. 6 is a side view illustrating the left-side surface of the antenna device 1. In (a) through (d) of FIG. 6, the film antenna 10 is omitted so that the wiring path of the coaxial cable 20 can be easily recognized.

The film antenna 10 connected to the coaxial cable 20 is wound around the support 30. The connection part of the end part of the coaxial cable 20 and the feed section 14 is contained in the first and second recesses 37 and 38 provided on the third supporting surface 33 of the support 30. Then, as illustrated in (c) of FIG. 6, the coaxial cable 20, which is drawn from the feed section 14 toward the left-side surface of the support 30 (toward the y-axis negative side of the coordinate system illustrated), is (i) bent frontwards with respect to the support 30 (toward the x-axis negative side in the coordinate system illustrated) and then (ii) fitted into the second holding part 35. The left-side surface of the support 30 intersects the first supporting surface 31, the second supporting surface 32, and the third supporting surface 33. The second holding part 35 holds the coaxial cable 20 so that part of the coaxial cable 20 extends (i) in a direction along the first supporting surface 31 and the third supporting surface 33 and (ii) in a direction that intersects the second supporting surface 32.

As illustrated in (b) of FIG. 6, the coaxial cable 20 after being fitted into the second holding part 35 is (i) bent upwards with respect to the support 30 (toward the z-axis positive side in the coordinate system illustrated) and (ii) bent rightwards (toward the y-axis positive side in the coordinate system illustrated). Then, the coaxial cable 20 is fitted into the first holding part 34. The first holding part 34 holds the coaxial cable 20 so that part of the coaxial cable 20 extends in a direction along the first supporting surface 31 and the second supporting surface 32.

As illustrated in (a) of FIG. 6, the coaxial cable 20 after being fitted into the first holding part 34 is bent frontwards with respect to the support 30 (toward the x-axis negative side in the coordinate system illustrated).

In the wiring path of the coaxial cable 20 thus arranged, the first holding part 34 is preferably provided outside of a spatial region sandwiched between the region 10*a* of the film antenna 10 and the region 10*c* of the film antenna 10. That is, in a plan view of the support 30, the first holding part 34 is preferably provided outside of the first supporting surface 31 (see (a) of FIG. 6). In the wiring path of the coaxial cable 20, the second holding part 35 is also preferably provided outside of the first supporting surface 31. These configurations allow the coaxial cable 20 to be easily fitted into each of the first holding part 34 and the second holding part 35 even after the film antenna 10 is wound around the support 30. This allows for a reduction in time and effort needed to produce the antenna device 1, and therefore allows for a reduction in costs for producing the antenna device 1.

As illustrated in (b) of FIG. 6, one of the characteristics of the wiring path of the coaxial cable 20 is that part of the coaxial cable 20, which part extends in the direction along the first supporting surface 31 and the second supporting surface 32, is held by the first holding part 34 so that a distance D1 between the part and the first supporting surface 31 is equal to a distance D2 between the part and the third supporting surface 33. This configuration allows an excellent radiation characteristic to be obtained even in a case where the wiring path is configured so that part of the coaxial cable 20 extends across the third supporting surface 33. The radiation characteristic in such a case will be described later in Example 1.

Note that the part of the coaxial cable 20, which part extends in the direction along the first supporting surface 31 and the second supporting surface 32, can be held by the first holding part 34 so that the distance D1 is equal to or greater than the distance D2. This configuration also restricts deterioration of a radiation characteristic even in a case where the wiring path is configured so that part of the coaxial cable 20 extends across the third supporting surface 33. The radiation characteristic in such a case will be described later in Example 2.

As illustrated in (a) of FIG. 2, (i) the recesses 34*b* of the first holding part 34 are preferably opened upwards with respect to the support 30 (toward the z-axis positive side in the coordinate system illustrated) and (ii) the recess 35*b* of the second holding part 35 is opened downwards with respect to the support 30 (toward the z-axis negative side in the coordinate system illustrated). The recess 36*b* of the third holding part 36 is preferably opened downwards with respect to the support 30 (toward the z-axis negative side in the coordinate system illustrated). That is, it is preferable that (i) the recess 35*b* and the recess 36*b* are made in the second and third holding parts 35 and 36, respectively, so as to be opened in a first direction in which the first and second recesses 37 and 38 made in the third supporting surface 33 are opened and (ii) the recesses 34*b* is made in the first holding part 34 so as to be opened in a second direction opposite the first direction.

This configuration allows the support 30, which includes the first through third holding parts 34, 35, and 36, to be easily formed with the use of a pair of upper and lower dies, and therefore allows for a reduction in costs for producing the antenna device 1. In addition, since the holding parts for holding the coaxial cable 20 are provided in an upper side and a lower side of the support 30, it is possible to increase durability with respect to pulling of the coaxial cable 20 (durability of the connection part via which the coaxial cable 20 and the feed section 14 are connected).

It is preferable that as illustrated in (b) and (c) of FIG. 6, (i) the second holding part 35 is provided further downwards with respect to the support 30 (toward the z-axis negative side in the coordinate system illustrated) than the first holding part 34 and (ii) part of the coaxial cable 20 held by the first holding part 34 and the second holding part 35 extends in a direction (along the z-axis) that intersects the first and third supporting surfaces 31 and 33 between the first holding part 34 and the second holding part 35. It is also preferable that as illustrated in (b) of FIG. 6, (i) the third holding part 36 is provided further downwards with respect to the support 30 (toward the z-axis negative side in the coordinate system illustrated) than the first holding part 34 and (ii) part of the coaxial cable 20 held by the first holding part 34 and the third holding part 36 extends, between the first holding part 34 and the third holding part 36, in a direction (along the z-axis) that intersects the first and third supporting surfaces 31 and 33.

That is, part of the coaxial cable 20, which part extends toward the y-axis negative side from the resin mold part 21 contained in the first and second recesses 37 and 38, is bent and then held by the second holding part 35 so as to extend toward the x-axis negative side (see (d) of FIG. 6). Then, part of the coaxial cable 20, which part is held by the second holding part 35, is (i) bent toward the z-axis positive side so as to extend toward the first holding part 34 and then (ii) bent and held by the first holding part 34 so as to extend toward the y-axis positive side (see (a) through (c) of FIG. 6). Then, part of the coaxial cable 20, which part is held by the first holding part 34, is (i) bent toward the z-axis negative side so as to extend toward the third holding part 36 and then (ii) bent and held by the third holding part 36 so as to extend toward the x-axis negative side (see (b) and (d) of FIG. 6).

With this configuration, in a case where force to pull the coaxial cable 20 from the antenna device 1 is applied, bent parts of the coaxial cable 20 are subjected to force to straighten the bent parts. This (1) causes part of the coaxial cable 20, which part is held (sandwiched) by the first holding part 34, to be more firmly pressed against the recesses 34*b* of the first holding part 34 and (2) causes part of the coaxial cable 20, which part is held by the second holding part 35, to be more firmly pressed against the recess 35*b* of the second holding part 35. Therefore, even in a case where force to pull the coaxial cable 20 from the antenna device 1 is applied, it is still possible to prevent the coaxial cable 20 from being detached from the first holding part 34 and the second holding part 35. In addition, since the coaxial cable 20 is held by these holding parts, the connection part of the feed section 14 and the coaxial cable 20 is prevented from being subjected to pulling force even in a case where the pulling force to pull the coaxial cable 20 from the antenna device 1 is applied.

A surface of the second holding part 35, which surface is in contact with a bent part of the coaxial cable 20, is preferably a smooth curved surface. In Embodiment 1, as illustrated in (b) of FIG. 6, the surface of the second holding part 35 in contact with the bent part of the coaxial cable 20 is configured to be a curved surface by chamfering an end part of the second holding section 35, which end part faces frontwards with respect to the support 30 (i.e. toward the x-axis negative side in the coordinate system illustrated). With this configuration, even in a case where force to pull the coaxial cable 20 from the antenna device 1 is applied, the end part of the second holding part 35, which end part faces frontwards with respect to the support 30, is prevented from damaging and eventually breaking the coaxial cable 20.

[Antenna Device Production Method]

(First Production Method)

A first production method of producing the antenna device 1 in accordance with Embodiment 1 includes: (i) a step of connecting the coaxial cable 20 to the feed section 14 of the film antenna 10 and (ii) a resin mold part forming step of forming the resin mold part 21 which covers the feed section 14 and covers the end part of the coaxial cable 20, which end part is connected to the feed section 14.

The first production method can further include the step of preparing the support 30 which (i) has: the first supporting surface 31; the second supporting surface 32 intersecting the first supporting surface 31; and the third supporting surface 33 facing the first supporting surface 31 and intersecting the second supporting surface 32, (ii) includes the first and the second holding parts 34 and 35 (holding section) for holding the coaxial cable 20, and (iii) is configured so that the first and second recesses 37 and 38 (recessed containing part) for containing the resin mold part 21 are provided in the third supporting surface 33.

The first production method can further include (i) a winding step of: attaching the film antenna 10 to the support 30 so that the resin mold part 21 is contained in the first and second recesses 37 and 38; and winding the film antenna 10 around the support 30 so that the film antenna 10 comes into contact with the first supporting surface 31, the second supporting surface 32, and the third supporting surface 33 and (ii) a wiring step of wiring the coaxial cable 20 so that: the coaxial cable 20 is held by the first and the second holding parts 34 and 35; and part of the coaxial cable 20 extends in a direction along the first supporting surface 31 and the second supporting surface 32.

In the resin mold part forming step in accordance with Embodiment 1, the resin mold part 21 is formed by injection molding in which a resin molding die is used.

Specifically, (i) the film antenna 10, in which the end part of the coaxial cable 20 is connected to the feed section 14, is set in a die and then (ii) a region, which includes the feed section 14 and which is located in the vicinity of the feed section, is contained in a cavity of the die. Then, the cavity is filled with a high-temperature molten resin material, and then the molten resin material is hardened by being cooled in the cavity. Then, by taking the film antenna 10 out of the die, it is possible to obtain the film antenna 10 in which the resin mold part 21 covers the feed section 14 and covers the end part of the coaxial cable 20 which end part is connected to the feed section 14.

Examples of a resin material of which the resin mold part 21 is made encompass, but are not limited to, (i) moisture curing urethane-based hot melt (such as "TECHNOMELT PUR 9515" manufactured by Henkel AG & Co. KGaA), (ii) a thermosetting resin, and (iii) an ultraviolet-curing resin.

Embodiment 1 discussed producing of the antenna device 1 by (i) covering, with the resin mold part 21, the connection part of the feed section 14 of the film antenna 10 and the coaxial cable 20 and then (ii) winding the film antenna 10 around the support 30. However, the present invention is not limited to this production method. A second production method will be described in detail below.

(Second Production Method)

The second production method of producing the antenna device 1 in accordance with Embodiment 1 includes (i) a connecting step of connecting the coaxial cable 20 to the feed section 14 of the film antenna 10 and (ii) the step of preparing the support 30 which (a) has: the first supporting surface 31; the second supporting surface 32 intersecting the first supporting surface 31; and the third supporting surface 33 facing the first supporting surface 31 and intersecting the second supporting surface 32, (b) includes the first and the second holding parts 34 and 35 (holding section) for holding the coaxial cable 20, and (c) is configured so that the first and second recesses 37 and 38 (recessed containing part) for containing the feed section 14 are provided in the third supporting surface 33.

The second production method can further include (i) a winding step of: attaching the film antenna 10 to the support 30 so that the connection part of the feed section 14 and the coaxial cable 20 is contained in the first and second recesses 37 and 38 (recessed containing part); and winding the film antenna 10 around the support 30 so that the film antenna 10 comes into contact with the first supporting surface 31, the second supporting surface 32, and the third supporting surface 33 and (ii) a wiring step of wiring the coaxial cable 20 so that: the coaxial cable 20 is held by the first and the second holding parts 34 and 35 (holding section); and part of the coaxial cable 20 extends in a direction along the first supporting surface 31 and the second supporting surface 32.

The second production method can further include a resin mold part forming step of, after the above steps are carried out, (i) filling, with a liquid resin material, the first and second recesses 37 and 38 (recessed containing part) in which the connection part of the feed section 14 and the coaxial cable 20 is contained and (ii) hardening the liquid resin material so as to form the resin mold part 21 that covers the feed section 14 and covers the end part of the coaxial cable 20 which end part is connected to the feed section 14.

[Example of Providing Antenna Device in Vehicle]

The antenna device 1 can be provided various structures. Examples of the structures encompass a vehicle body of an automobile. An example in which the antenna device 1 is provided in a vehicle body will be described below with reference to FIG. 7. (a) of FIG. 7 is a perspective view illustrating a vehicle body 50 on which a spoiler 52 including an antenna device 1 is provided. (b) of FIG. 7 is a perspective view illustrating the spoiler 52.

As illustrated in (a) of FIG. 7, the spoiler 52 is provided at a back end part of a roof 51 of the vehicle body 50. The spoiler 52 is an integrally-formed resin member. The spoiler 52 has a (i) structure (not shown) for setting the spoiler 52 to a certain position relative to the back end part of the roof 51 and (ii) a structure (not shown) for fixing the spoiler 52 to a certain position of the roof 51. The spoiler 52 is fixed to the certain position of the roof 51 by these structures.

The spoiler 52 has functions such as restricting irregular airflows (rectifying the airflow) at a back part of the vehicle body 50 and improving an appearance of the vehicle body 50. For the purpose of rectifying airflows, the spoiler 52 is configured to gradually decrease in vertical size toward the back end part. A void is made in the back part of the spoiler 52 (i.e. the back part has a hollow structure) (see (b) of FIG. 7).

In the present example, the antenna device 1 including the spoiler 52 is achieved by providing the antenna device 1 in the void. The antenna device 1 is provided in the spoiler 52 in such a manner as to be upside down in comparison with the orientation of the antenna device 1 illustrated in FIG. 1, so that the third supporting surface 33 of the support 30 faces toward a top surface of the spoiler 52 of the vehicle body 50.

Embodiment 2

The following description will next discuss an antenna device 1α in accordance with Embodiment 2.

As described above, the antenna device 1 in accordance with Embodiment 1 can be provided on, for example, a vehicle body of an automobile. Note, however, that depending on how the antenna device 1 is provided on a vehicle body, there is a possibility that the end part of the film antenna 10 is blown by wind, so that the film antenna 10 vibrates and consequently makes a noise such as a whizzing sound. There is also a possibility that in a case where the end part of the film antenna 10 continues to be blown by wind, the end part becomes deformed.

Therefore, the antenna device 1α in accordance with Embodiment 2 is an antenna device which is further intended to prevent the occurrences of such noises and deformations.

The antenna device 1α in accordance with Embodiment 2 will be described below with reference to FIGS. 8 through 10. Note that members similar to those of the antenna device 1 in accordance with Embodiment 1 will be given the same reference numerals, and their descriptions will be omitted. (a) of FIG. 8 is a perspective view illustrating the antenna device 1α. (b) of FIG. 8 is an exploded perspective view illustrating the antenna device 1α. Note that a part (cable part) of a coaxial cable 20 other than the resin mold part 21α is omitted from each of (a) and (b) of FIG. 8. FIG. 9 is a plan view illustrating a film antenna 10α included in the antenna device 1α. (a) of FIG. 10 is an enlarged plan view illustrating a support 30α included in the antenna device 1α. (b) of FIG. 10 is an enlarged perspective view illustrating the support 30α.

The antenna device 1α includes the film antenna 10α, the coaxial cable 20, and the support 30α. The film antenna 10α corresponds to the film antenna 10 included in the antenna device 1 in accordance with Embodiment 1. The support 30α corresponds to the support 30 included in the antenna device 1 in accordance with Embodiment 1. The resin mold part 21α corresponds to the resin mold part 21 included in the antenna device 1 in accordance with Embodiment 1.

As illustrated in (b) of FIG. 8, the support 30α differs from the support 30 of the antenna device 1 in accordance with Embodiment 1 in that the support 30α has a slot 31*c*. The slot 31*c* is a hole made in a direction from the a first supporting surface 31 of the support 30α toward a third supporting surface 33 (not shown in FIG. 8) (toward the z-axis negative side in the coordinate system illustrated). A shape of an opening 31*ap* of the slot 31*c* made in the first supporting surface 31 is a rectangle whose (i) longer sides extend along the y-axis in the coordinate system illustrated and (ii) shorter sides extend along the x-axis in the coordinate system illustrated. The slot 31*c*, whose shape is obtained by advancing the rectangular opening 31*ap* toward the z-axis negative side, has an inner space which is a rectangular parallelepiped that consists of four side walls, specifically a pair of side walls including the longer sides of the opening 31*ap* (pair of side walls facing each other) and a pair of side walls including the shorter sides of the opening 31*ap* (pair of side walls facing each other).

As illustrated in FIG. 9, the film antenna 10α is obtained by replacing, with a dielectric film 11α, the dielectric film 11 included in the film antenna 10 of the antenna device 1 in accordance with Embodiment 1. The dielectric film 11α is obtained by extending the dielectric film 11 in Embodiment 1 away from the feed section 14. That is, the film antenna 10α, which includes the dielectric film 11α, further includes, in addition to regions 10*a* through 10*d*, a region 10*e* (fourth region: end part on a first antenna conductor 12-side) which expands from an edge on the first antenna conductor 12-side to a line D-D'. The region 10*e* has rectangular openings 11*a*.

As illustrated in (b) of FIG. 8, the film antenna 10α is wound around the support 30α by folding the film antenna 10α in a U shape whose ridgelines are a line A-A' and a line B-B'. By folding the film antenna 10α along the line D-D' as a ridgeline, it is made possible to insert the region 10*e* into the slot 31*c* of the support 30α.

On the side walls (side walls including the longer sides of the opening 31*ap*) of the slot 31*c*, a total of two fixing parts for preventing the region 10*e* from being detached from the slot 31*c* are provided such that one of the two fixing parts and the other one of the two fixing parts are provided toward the y-axis positive side and the y-axis negative side, respectively, in the coordinate system illustrated. FIG. 10 is an enlarged view illustrating the one of the two fixing parts which is provided toward the y-axis negative side. The one of the two fixing parts which is provided toward the y-axis negative side is made up of (i) a rib 31*d* and a rib 31*e* which are a pair of ribs and (ii) a wedge-shaped protrusion 13*f*. The other fixing part provided toward the y-axis positive side is configured as is the fixing part provided toward the y-axis negative side.

As illustrated in (a) of FIG. 10, the rib 31*d* and the rib 31*e* are each a protrusion protruding from one side wall (side wall on the x-axis positive side in the coordinate system illustrated) to the other side wall (side wall on the x-axis negative side in the coordinate system illustrated) of the pair of side walls including the longer sides of the opening 31*ap*. The rib 31*d* and the rib 31*e* each extend linearly in a direction from the first supporting surface 31 toward the third supporting surface 33 (toward the z-axis negative side in the coordinate system illustrated). That is, the rib 31*d* and the rib 31*e* extend parallel to each other. In Embodiment 2, an amount by which each of the rib 31*d* and the rib 31*e* protrudes (i.e. height measured from the side wall on the x-axis positive side) is ½ of a length of the shorter side of the opening 31*ap*.

The wedge-shaped protrusion 13*f* is a protrusion protruding from one side wall (on the x-axis negative side) toward the other side wall (on the x-axis positive side) of the pair of side walls including the longer sides of the opening 31*ap*. In a plan view of the opening 31*ap*, the wedge-shaped protrusion 13*f* is located in the middle between the rib 31*d* and the rib 31*e* along the y-axis in the coordinate system illustrated. The wedge-shaped protrusion 13*f* is also located in the middle between the first supporting surface 31 and the third supporting surface 33 in regard to a depth of the slot 31*c* (along the z-axis in the coordinate system illustrated).

When the wedge-shaped protrusion 13*f* is viewed from the y-axis negative side in the coordinate system illustrated, the wedge-shaped protrusion 13*f* has a shape of a trapezoid (see (b) of FIG. 10). A slope 31*f*1, which corresponds to one of the two legs of the trapezoid, intersects, at an acute angle, the side wall on the x-axis negative side. A stopper 31*f*2, which corresponds to the other one of the two legs of the trapezoid, intersects, at a right angle, the side wall on the x-axis negative side. In other words, the amount by which the wedge-shaped protrusion 13*f* protrudes (i.e. height measured from the side wall on the x-axis negative side) (i) gradually increases from the first supporting surface 31 toward the third supporting surface 33, (ii) reaches a certain level (height of the trapezoid) and then remains at the certain level, and then (iii) drastically decreases to zero. In Embodiment 2, a maximum value of the amount by which the wedge-shaped protrusion 13*f* protrudes, that is, a maximum value of the height of the trapezoid, is preferably ½ of the length of the shorter sides of the opening 31*ap* or slightly greater than ½ of the length of the shorter sides of the opening 31*ap*.

Since the slope 31*f*1 is provided on the first supporting surface 31-side of the wedge-shaped protrusion 13*f*, the region 10*e* can be smoothly inserted into the slot 31*c*. In a case where the region 10*e* is inserted into the slot 31*c* and then the openings 11*a* (see FIG. 9) reach a position corresponding to the wedge-shaped protrusion 13*f*, the region 10*e* is pushed by the rib 31*d* and the rib 31*e* from the side wall on the x-axis positive side toward the side wall on the x-axis negative side of the slot 31*c*. This causes the openings 11*a* to be caught by the wedge-shaped protrusion 13*f*. Since the stopper 31*f*2, which is steep, is provided on the third supporting surface 33-side of the wedge-shaped protrusion 13*f*, the openings 11*a* are prevented from being unintentionally detached from the wedge-shaped protrusion 13*f* even in a case where force to pull the region 10*e* from the slot 31*c* is applied. That is, the region 10*e* does not unintentionally come off from the slot 31*c*.

With the antenna device 1α thus configured, the region 10*e*, which is the end part of the film antenna 10α, is contained in the slot 31*c* and is prevented from coming off. This allows the film antenna 10α to be in close contact with the support 30α even in a case where the antenna device 1α is provided so as to be blown by wind. Hence, even in a case where the film antenna 10α is blown by the wind, the film antenna 10α does not vibrate. It is therefore possible to prevent the occurrence of a noise such as a whizzing sound. It is also possible to prevent the end part of the film antenna 10α from being deformed.

A production method of producing the antenna device 1α is similar to the production method of producing the antenna device 1, except that the step of inserting the region 10*e* into the slot 31*c* is further included in the winding step.

<<Preferable Wiring Path of Coaxial Cable>>

It is known that radiation characteristics of an antenna device can be easily affected by an environment surrounding the antenna device. The inventors of the present invention found that with the antenna device 1 in accordance with Embodiment 1 in which the coaxial cable 20 extends across the third supporting surface 33 in a direction along the second supporting surface 32, a radiation characteristic of the antenna device 1 changes, depending on the wiring path of the coaxial cable 20 extending from the feed section 14. Specifically, the radiation characteristic of the antenna device 1 changes, depending on a relationship in length between distances from a part of the coaxial cable 20, which part is held by the first holding part 34, to the first and the second antenna conductors 12 and 13 (between the distance D1 and the distance D2).

The following description will discuss the results of measuring radiation characteristics in cases where distances from the coaxial cable 20 to the first and the second antenna conductors 12 and 13 (between the distance D1 and the distance D2) by changing the depth of the recesses 34*b* of the first holding part 34 of the antenna device 1 in accordance with Embodiment 1.

In measurements of the radiation characteristics, the following antennas were used: (i) an antenna device 1 in which a coaxial cable 20 is held by a first holding part 34 so that D2=D1 (Example 1), (ii) an antenna device 1 in which a coaxial cable 20 is held by a first holding section 34 so that D2≥D1 (Example 2), and (iii) an antenna device in which a coaxial cable 20 is held by a first holding section 34 so that D2<D1 (Example 3).

As a Reference Example for studying the radiation characteristics of the antennas in Examples, an antenna device, in which a coaxial cable drawn from a feed section does not extend across a film antenna, is used. In the antenna device in accordance with Reference Example, the coaxial cable drawn from the feed section is then provided away from the antenna device without being fitted into a second holding part 35 or a first holding part 34. That is, the antenna device in accordance with Reference Example is configured so that there is no strength with respect to pulling of the coaxial cable.

Note that the film antenna included in the antenna device in accordance with Reference Example is identical to the film antenna 10 included in the antenna device 1 in accordance with Embodiment 1, and is wound around a support 30 in a manner identical to that in which the film antenna 10 is wound around the support 30. That is, the antenna device in accordance with Reference Example differs from the antenna device 1 only in that the coaxial cable 20 is not held by the first holding part 24 of the support 30.

The antenna device in accordance with Reference Example will be first described with reference to FIG. 11. FIG. 11 is a graph showing (i) VSWR (Voltage Standing Wave Ratio) of the antenna device in accordance with Reference Example and (ii) a frequency dependency of an average gain of the antenna device in accordance with Reference Example. The average gain is calculated by averaging, over entire 360°, radiant gains obtained by the antenna device on an x-y plane.

Plotting of the VSWR shown in FIG. 11 indicates that the VSWR of the antenna device in accordance with Reference Example is (i) below 2 in an 800 MHz band and (ii) drastically increased in a frequency band of 700 MHz or less. Plotting of the average gain of entire polarized waves in the horizontal plane shown in FIG. 11 indicates that the antenna device in accordance with Reference Example exhibits an excellent average gain greater than −1 dBi in the 800 MHz band.

Example 1

Example 1 of the antenna device 1 will be described next with reference to FIG. 12. FIG. 12 is a graph showing (i) VSWR of the antenna device 1 in accordance with Example 1 and (ii) a frequency dependency of an average gain of the antenna device 1 in accordance with Example 1.

The antenna device 1 in accordance with Example 1 can be obtained by configuring the antenna device 1 in accordance with Embodiment 2 so that (i) the support 30 has a height (length along the z-axis in the coordinate system illustrated in FIG. 1) of 17.0 mm, (ii) the coaxial cable 20 has a radius of 1.4 mm, and (iii) the distance D1 and the distance D2 are each 8.5 mm. That is, the antenna device 1 in accordance with Example 1 is configured so that D2=D1. Note that the film antenna 10 included in the antenna device 1 in accordance with Example 1 is designed to obtain a preferable radiation characteristic in the 800 MHz band.

Plotting of the VSWR shown in FIG. 12 indicates that the VSWR of the antenna device 1 in accordance with Example 1 is (i) below 2 in an 800 MHz band and (ii) drastically increased in a frequency band of 700 MHz or less. Plotting of the average gain of entire polarized waves in the horizontal plane shown in FIG. 11 indicates that the antenna device 1 in accordance with Example 1 exhibits an excellent average gain greater than −1 dBi in the 800 MHz band.

It was thus found that although the antenna device 1 in accordance with Example 1 is configured so that the coaxial cable 20 extends across the film antenna 10, the antenna device 1 in accordance with Example 1 still exhibits a radiation characteristic comparable to that of the antenna device in accordance with Reference Example which is configured so that the coaxial cable is provided away from the antenna device while the coaxial cable does not extend across the film antenna.

Example 2

Example 2 of the antenna device 1 will be described next with reference to FIG. 13. FIG. 13 is a graph showing (i)

VSWR of the antenna device 1 in accordance with Example 2 and (ii) a frequency dependency of an average gain of the antenna device 1 in accordance with Example 2.

The antenna device 1 in accordance with Example 2 is obtained by configuring the antenna device 1 so that a distance D1 and a distance D2 are 15.6 mm and 1.4 mm, respectively. That is, the antenna device 1 in accordance with Example 2 is configured so that the distance D1 is equal to or greater than the distance D2. The antenna device 1 in accordance with Example 2 and the antenna device 1 in accordance with Example 1 are identical except for the numerical values of the distance D1 and the distance D2.

Plotting of the VSWR shown in FIG. 13 indicates that the VSWR of the antenna device 1 in accordance with Example 2 is (i) approximately 2 in an 800 MHz band and (ii) drastically increased in a frequency band of 700 MHz or less. Plotting of the average gain of entire polarized waves in the horizontal plane shown in FIG. 13 indicates that the antenna device 1 in accordance with Example 2 exhibits an excellent average gain greater than −1 dBi in the 800 MHz band.

It was thus found that although the antenna device 1 in accordance with Example 2 is configured so that the coaxial cable 20 extends across the film antenna 10, the antenna device 1 in accordance with Example 2 still exhibits a radiation characteristic comparable to that of the antenna device in accordance with Reference Example which is configured so that the coaxial cable does not extend across the film antenna.

Example 3

Example 3 of the antenna device 1 will be described next with reference to FIG. 14. FIG. 14 is a graph showing (i) VSWR of the antenna device 1 in accordance with Example 3 and (ii) a frequency dependency of an average gain of the antenna device 1 in accordance with Example 3.

The antenna device 1 in accordance with Example 3 is obtained by configuring the antenna device 1 in accordance with Embodiment 2 so that a distance D1 and a distance D2 are 1.4 mm and 15.6 mm, respectively. That is, the antenna device 1 in accordance with Example 3 is configured so that the distance D1 is less than the distance D2. The antenna device 1 in accordance with Example 3 and the antenna devices 1 in accordance with Examples 1 and 2 are identical except for the numerical values of the distance D1 and the distance D2.

Plotting of the VSWR shown in FIG. 14 indicates that the VSWR of the antenna device 1 in accordance with Example 3 is (i) approximately 2 in an 800 MHz band but (ii) not increased in a frequency band of 700 MHz or less. The average gain of the entire polarized waves is considerably below −1 dBi in the 800 MHz band.

It was thus found that with the antenna device 1 in accordance with Example 3 in which the coaxial cable extends across the film antenna as well as the distance D2 is less than the distance D1, (i) the VSWR exhibits a shape differing from that of the antenna device in accordance with Reference Example and (ii) the average gain becomes considerably reduced.

From the results of Examples 1 through 3, it was found that in a case where an antenna device is configured so that a coaxial cable 20 is held by a first holding part 34 (i.e. the coaxial cable 20 extends across a film antenna 10), a distance D2 is preferably equal to or greater than a distance D1. Note that similar results can be obtained in a case where the coaxial cable 20 held by the first holding part 34 does not extend across the film antenna 10 but part of the coaxial cable 20 is drawn frontwards (see Embodiment 4 described later).

Embodiment 3

The following description will discuss, with reference to FIGS. 15 and 16, a configuration of an antenna device 1β in accordance with Embodiment 3 of the present invention. (a) of FIG. 15 is a perspective view illustrating a support 30A included in the antenna device 1β. (b) of FIG. 15 is a perspective view illustrating the antenna device 1β. FIG. 16 is a flow chart showing a production method of producing the antenna device 1β.

[Configuration of Antenna Device]

The antenna device 1β in accordance with Embodiment 3 can be obtained by replacing the support 30 and the resin mold part 21 in the antenna device 1 in accordance with Embodiment 1 with a support 30A and a resin mold part 21A, respectively. Therefore, in Embodiment 3, the support 30A and the resin mold part 21A will be mainly described. Note that members similar to those of the antenna device 1 will be given the same reference numerals, and their descriptions will be omitted.

As illustrated in (a) of FIG. 15, the support 30A has a third supporting surface 33 on which a first recess 37A, a second recess 38A, and an L-shaped groove 37B are provided. The first and second recesses 37A and 38A correspond in configuration to the first and second recesses 37 and 38 of Embodiment 1, respectively. The L-shaped groove 37B is a groove which is continuous with the first recess 37A and which extends toward an end part of the third supporting surface 33. During forming of a resin mold part 21A described later, the L-shaped groove 37B serves as a vent through which air present in the first recess 37A is passed out.

As is the case of the support 30 of the antenna device 1 in accordance with Embodiment 1, the support 30A is a structure having (i) a first supporting surface 31, (ii) a second supporting surface 32 intersecting the first supporting surface 31, and (iii) a third supporting surface 33 facing the first supporting surface 31 and intersecting the second supporting surface 32, and a film antenna 10 is to be wound around the support 30A so as to come into contact with the first through third supporting surfaces 31 through 33. In addition, the support 30A includes a first holding part 34, a second holding part 35, and a third holding part 36 for holding a coaxial cable 20 which is connected to the film antenna 10. The coaxial cable 20 connected to the film antenna 10 is wired as is the case of the support 30 of the antenna device 1 in accordance with Embodiment 1.

[Production Method of Producing Antenna Device 1β]

The production method of producing the antenna device 1β in accordance with Embodiment 3 includes (i) a connecting step of connecting the coaxial cable 20 to a feed section 14 of the film antenna 10 and (ii) the step of preparing the support 30A which (a) has: the first supporting surface 31; the second supporting surface 32 intersecting the first supporting surface 31; and the third supporting surface 33 facing the first supporting surface 31 and intersecting the second supporting surface 32, (b) includes the first and the second holding parts 34 and 35 (holding section) for holding the coaxial cable 20, and (c) is configured so that the first and second recesses 37A and 38A (recessed containing part) for containing the feed section 14 are provided in the third supporting surface 33.

The production method can further include (i) a winding step of: attaching the film antenna 10 to the support 30A so that the feed section 14 is contained in the first and second recesses 37A and 38A (recessed containing part); and winding the film antenna 10 around the support 30 so that the film antenna 10 comes into contact with the first supporting surface 31, the second supporting surface 32, and the third supporting surface 33 and (ii) a wiring step of wiring the coaxial cable 20 so that: the coaxial cable 20 is held by the first and the second holding parts 34 and 35 (holding section); and part of the coaxial cable 20 extends in a direction along the first supporting surface 31 and the second supporting surface 32.

The production method can further include a resin mold part forming step of (i) filling, with a liquid resin material, the first and second recesses 37A and 38A (recessed containing part) in which the feed section 14 is contained and (ii) hardening the liquid resin material so as to form the resin mold part 21A that covers the feed section 14 and covers the end part of the coaxial cable 20 which end part is connected to the feed section 14. In Embodiment 3, since the L-shaped groove 37B which is continuous with the first recess 37A is provided, it is possible to pass out air which is present in the first and second recesses 37A and 38A (recessed containing part). This allows the liquid resin material to smoothly flow in. Therefore, the occurrence of bubbles or the like is restricted in a case where a liquid resin material is allowed to flow in, so that it is possible to form a resin mold part 21A which covers a connection part of the end part of the coaxial cable 20 and the feed section 14.

The production method of producing the antenna device 1β will be described below in detail with reference to FIG. 11.

In Embodiment 3, the antenna device 1β is produced by carrying out the resin mold part forming step (steps S102, S104, S106, S108) after carrying out the connecting step, the winding step, and the wiring step (step S100).

As illustrated in FIG. 16, the resin mold part forming step includes (i) a jig setting step (step S102) of setting the support 30A, around which the film antenna 10 is wound, between a pair of fixing plates by which a jig 100 is constituted, (ii) a pressure adding step (step S104) of sandwiching the support 30A, around which the film antenna 10 is wound, with the pair of fixing plates and then adding a pressure, (iii) a filling step (step S106) of injecting a liquid resin material from an end part of the second recess 38A of the support 30A so as to fill the first recess 37A with the liquid resin material, and (iv) an extracting step (step S108) of hardening the liquid resin material filling the first recess 37A so as to form a resin mold part 21A and then taking out an antenna device 1β from the jig 100.

In the jig setting step (step S102), the support 30A, around which the film antenna 10 is wound, is set between the pair of fixing plates by which the jig 100 is constituted. In so doing, (i) the pair of fixing plates face corresponding ones of the first and third supporting surfaces 31 and 33 of the support 30A and (ii) the support 30A is oriented so that the second holding part 35 of the support 30A faces upwards. This causes the first and second recesses 37A and 38A provided in the third supporting surface 33 to be aligned vertically such that the end part of the second recess 38A, which is continuous with the first recess 37A, is located at an upper end of the support 30A.

In the pressure adding step (step S104), the pair of fixing plates apply pressure to corresponding ones of the first supporting surface 31 and the third supporting surface 33 of the support 30A, around which the film antenna 10 is wound. This allows the film antenna 10 to be pressed against the support 30A with a more uniform pressure, so that the film antenna 10 comes into close contact with the first and third supporting surfaces 31 and 33. Therefore, in a case where the first recess 37A provided in the third supporting surface 33 is filled with the liquid resin material in the next step (step S106), it is possible to prevent the resin material from leaking out of the first recess 37A.

In the filling step (step S106), the liquid resin material is injected from the end part (upper end part) of the second recess 38A, so that the first recess 37A is filled with the liquid resin material.

In so doing, since the coaxial cable 20 is penetrating through the second recess 38A, the liquid resin material is injected through a gap between the second recess 38A and the coaxial cable 20. Therefore, in order to make it easy to inject the resin material through the gap, it is possible to, for example, inject the liquid resin material with the use of a tapered needle. Alternatively, in order to reduce the amount of time required for the filling, it is possible to, for example, inject the liquid resin material while pressure is applied.

Note that air, which is present in the first recess 37A, can be passed out due to the L-shaped groove 37B that is continuous with the first recess 37A. This allows the liquid resin material, which has been injected through the upper end part of the second recess 38A, to flow into the first recess 37A, so that the first recess 37A is filled with the liquid resin material.

In the extracting step (step S108), the liquid resin material, with which the first recess 37A is filled, is hardened so as to form a resin mold part 21A which covers (i) the feed section 14 contained in the first recess 37A and (ii) the end part of the coaxial cable 20, which end part is connected to the feed section 14. After the resin mold part 21 is formed, the pair of fixing plates with which the support 30A is sandwiched is taken out, and an antenna device 1β is taken out of the jig 100.

Note that a timing with which the antenna device 1β is taken out of the jig 100 (i.e. a timing with which (i) the pressure applied in directions in which the support 30A was sandwiched is released and (ii) the pair of fixing plates is taken out) can be set as appropriate according to, for example, the amount of time required for hardening the resin, a viscosity of the resin, and air temperature.

Examples of the resin material of which the resin mold part 21A is made encompass, but are not limited to, a two-liquid-mixture type urethane resin (e.g. WEVOPUR PD 4 manufactured by WEVO-CHEMIE).

Note that a resin mold part 21A, which is made with the use of WEVOPUR PD 4 manufactured by WEVO-CHEMIE, is formed by hardening, at normal temperature, a liquid resin material with which the first recess 37A is filled at normal temperature. Therefore, the resin mold part 21A has such an advantage as causing less stress to be applied to the film antenna 10, in comparison with the resin mold part 21 of the antenna device 1 in accordance with Embodiment 1, formed by injection molding with the use of TECHNOMELT PUR 9515, manufactured by Henkel AG & Co. KGaA, which is a moisture curing urethane-based hot melt. In addition, the resin mold part 21A made with the use of WEVOPUR PD 4 manufactured by WEVO-CHEMIE is small in degree of hardness, and therefore brings about such an advantage as being able to restrict peeling of the resin mold part 21A and the film antenna 10 from each other due to a difference in thermal expansion coefficient.

Note that the production method in accordance with Embodiment 3 was described such that the connecting step, the winding step, and the wiring step are carried out before the resin mold part forming step is carried out. Alternatively, the wiring step can be carried out after the resin mold part forming step has been carried out.

[Variation]

It is assumed that an antenna device is subjected to various temperature changes, and that various heat histories are added to an antenna device. The support 30A, the film antenna 10, and the resin mold part 21A of the antenna device 1β are made up of respective materials. Therefore, in a case where a heat history is added to the antenna device, an interface between the support 30A and the resin mold part 21A (first interface) and an interface between the resin mold part 21A and the film antenna 10 (second interface) are each subjected to stress due to differences in thermal expansion coefficient between the respective materials of which the support 30A, the film antenna 10, and the resin mold part 21A of the antenna device 1β are made.

In a case where a heat history is repeatedly added to the antenna device 1β, peeling ultimately occurs at any one of the first interface and the second interface. Whether the peeling occurs at the first interface or the second interface depends on (i) a balance between stress applied to the first interface and an adhesive force of the support 30A and the resin mold part 21A at the first interface and (ii) a balance between stress applied to the second interface and an adhesive force of the resin mold part 21A and the film antenna 10A at the second interface. In a case where the stress applied to the first interface is greater than the adhesive force of the support 30A and the resin mold part 21A, peeling occurs at the first interface. In a case where the stress applied to the second interface is greater than the adhesive force of the resin mold part 21A and the film antenna 10A, peeling occurs at the second interface.

The resin mold part 21A is intended to prevent the inner conductor and the outer conductor of the coaxial cable 20 and the feed section 14 from being exposed, so that a water-resistant property of the film antenna 10 is increased. Therefore, in a case where the resin mold part 21A and the film antenna 10 peel from each other at the second interface, the water-resistant property of the film antenna 10 unfortunately deteriorates. In contrast, in a case where the support 30A and the resin mold part 21A peel from each other at the first interface, the inner conductor and the outer conductor of the coaxial cable 20 and the feed section 14 remain covered with the resin mold part, so that the water-resistant property of the film antenna 10 is prevented from deteriorating.

An antenna device 1β', which is a variation of the antenna device 1β, is an antenna device which is further intended to prevent deterioration of the water-resistant property of the film antenna by restricting the peeling of the resin mold part 21A and the film antenna 10 from each other at the second interface.

The antenna device 1β' in accordance with the present variation, will be described below with reference to FIG. 17. (a) of FIG. 17 is a plan view illustrating a third supporting surface 33 of a support 30B included in the antenna device 1β'. More specifically, (a) of FIG. 17 is a plan view obtained when the third supporting surface 33 is viewed from the z-axis negative side in the coordinate system illustrated. (b) of FIG. 17 is an enlarged cross-sectional view illustrating the antenna device 1β'. More specifically, (b) of FIG. 17 is an enlarged cross-sectional view of the resin mold part 21B taken along the line A-A' in (a) of FIG. 17.

The antenna device 1β' is obtained by replacing the support 30A of the antenna device 1β with the support 30B. Note that a first recess 37C, a second recess 38B, and a J-shaped groove (groove) 37D of the support 30B correspond to the first recess 37A, the second recess 38A, and the L-shaped groove 37B of the support 30A, respectively. Note that members similar to those of the support 30A will be given the same reference numerals, and their description will be omitted.

The support 30B is obtained by making the following changes to the support 30A. Note that a recessed containing part is formed by (i) the J-shaped groove 37D that is continuous with the first recess 37C and that serves as a vent through which air present in the first recess 37C is passed out, (ii) the first recess 37C, and (iii) the second recess 38B.

Change 1: A shape of a cross section of the first recess 37C and a shape of a cross section of the J-shaped groove 37D are each changed from a rectangle to a shape shown in (b) of FIG. 17.

Change 2: An adhesive layer is provided in a region surrounding the recessed containing part in the third supporting surface 33.

Change 3: A shape of the J-shaped groove 37D, which is a groove, is changed from an L-shape to a J-shape (see (a) of FIG. 17).

[Change 1]

The shape of the cross section of the first recess 37C and the shape of the cross section of the J-shaped groove 37D will be described below with reference to (b) of FIG. 17. Since the shape of the cross section of the first recess 37C and the shape of the cross section of the J-shaped groove 37D are similar, the shape of the cross section of the first recess 37C will be described. As illustrated in (b) of FIG. 17, the shape of the cross section of the first recess 37C is configured so that the deeper the depth (i.e. distance along the z-axis in the coordinate system illustrated) from an opening made in the third supporting surface 33, the narrower the width (i.e. distance along the x-axis in the coordinate system illustrated). In other words, the width of the first recess 37C is (i) narrowest at a bottom part at which the depth from the opening is greatest, (ii) widest at the opening, and (iii) increasingly wider from the bottom part to the opening.

Note that the width of the first recess 37C can (i) change in any manner, provided that the width does not become narrower from the bottom part toward the opening and (ii) be partially unchanging relative to the depth from the opening.

The width of the first recess 37C is thus increasingly wider from the bottom part toward the opening. Therefore, a resin material, which is hardened after filling the first recess 37C and is to form the resin mold part 21B, can easily peel from the support 30B. Therefore, in a case where the antenna device 1β' is subjected to various temperature changes, the resin mold part 21B can easily peel from the support 30B at the first interface which is an interface between the support 30B and the resin mold part 21B. This prevents the resin mold part 21B from peeling from the film antenna 10 at the second interface which is an interface between the resin mold part 21B and the film antenna 10. Therefore, with the antenna device 1β', deterioration of the water-resistant property of the film antenna 10 can be more effectively prevented than is the case of the antenna device 1β.

Note that a surface of the first recess 37C is preferably smooth. In a case where the surface of the first recess 37C is uneven, there is a possibility that the resin material filling the first recess 37C may get into entire parts of the unevenness, so that an adhesive force occurring between the support 30B and the resin mold part 21B becomes strengthened (anchor effect). By configuring the surface of the first recess 37C to be as smooth as possible, it is possible to restrict an anchor effect, and therefore to restrict the adhesive force that occurs between the support 30B and the resin mold part 21B.

In order to more reliably prevent the resin mold part 21B from peeling from the film antenna 10, it is possible to coat the surface of the first recess 37C with a release material before the first recess 37C is filled with the resin material. This allows the resin mold part 21B, which is made of a resin material, to easily peel from the surface of the first recess 37C.

[Change 2]

As illustrated in (a) of FIG. 17, a double-sided tape 33*c*, which is an adhesive layer, is provided in the region surrounding the first recess 37C, the second recess 38B, and the J-shaped groove 37D that form the recessed containing part. Note that the adhesive layer can be an adhesive instead of a double-sided tape. As illustrated in (b) of FIG. 17, the film antenna 10 is attached to the third supporting surface of the support 30B with the use of the double-sided tape 33*c*. Therefore, in a filling step (step S106, see FIG. 16), a liquid resin material with which the first recess 37C is filled can easily prevented from flowing into a gap between the support 30B and the film antenna 10.

In a case where the antenna device 1β including the support 30A is to be produced, the first recess 37A is filled with a resin material while the support 30A is sandwich with the use of the jig 100 as in the step S106 shown in FIG. 16. However, in a case where the antenna device 1β' including the support 30B is to be produced, it is possible to fill the first recess 37C with a resin material even when the support 30B is not sandwiched with the use of a jig 100. That is, it is possible to omit a pressure adding step S104.

[Change 3]

In the support 30B included in the antenna device 1β', the J-shaped groove 37 instead of the L-shaped groove 37B is provided as a groove through which the inside of the first recess 37C and the outside of the support 30B are continuous. Note that the shape of the groove through which the inside of the first recess 37C and the outside of the support 30B are continuous is not limited to an L-shape or a J-shape, but can be another shape.

[Production Method of Producing Antenna Device 1β']

A production method of producing the antenna device 1β' differs from the production method of producing the antenna device 1β in the points described below. Note that steps similar to those included in the production method of producing the antenna device 1β will be given the same step number, and their descriptions will be omitted.

(Change 1 to Production Method)

Before a winding step is carried out, that is, between the step of preparing the support 30B and the winding step, the production method further includes an adhesive layer forming step of forming an adhesive layer (double-sided tape 33*c*) in the region surrounding the recessed containing part (the first recess 37C, the second recess 38B, and the J-shaped groove 37D) of the third supporting surface 33.

(Change 2 to Production Method)

The winding step further includes an attaching step of attaching, in a case where the film antenna 10 is to be wound around the support 30B, the film antenna 10 to the support 30B with the use of an adhesive layer (double-sided tape 33*c*).

Note that in the production method of producing the antenna device 1β', the pressure adding step S104 can be omitted. Specifically, the jig 100 is not necessary to fill the first recess 37C with a resin material. Therefore, the antenna device 1β' can be produced with a few steps than is the case of the antenna device 1β.

<<Storing Method of Providing Antenna Device in Accordance with Embodiments 1 Through 3 into Spoiler>>

The antenna devices 1, 1α, and 1β in accordance with Embodiments 1 through 3 can be each suitably provided in a spoiler 52 of an automobile, particularly in a spoiler 52 having a housing divided into a containing part and a lid part. A storing method of providing the antenna device 1 in accordance with Embodiment 1 into the spoiler 52 will be described below with reference to FIG. 18. FIG. 18 is a view illustrating the storing method of providing the antenna device 1 in the spoiler 52. Note that in FIG. 18, a shape of the antenna device 1 and a shape of the spoiler 52 are schematically illustrated so that the storing method can be easily recognized.

As illustrated in (a) of FIG. 18, the spoiler 52 has a housing divided into a containing part 52*a* and a lid part 52*b*. The containing part 52*a* includes a first compartment 52*a*1 and a second compartment 52*a*2 which are continuous with each other. The first compartment 52*a*1 is a space in which mainly the support 30 of the antenna device 1 is to be provided. The first compartment 52*a*1 is deeper in depth than the second compartment 52*a*2. In the first compartment 52*a*1, a pair of support plates 52*a*3 and 52*a*4 facing each other are provided. Meanwhile, the second compartment 52*a*2 is a space in which mainly the film antenna 10 of the antenna device 1 is to be provided. The second compartment 52*a*2 is shallower in depth than the first compartment 52*a*1. The first compartment 52*a*1 and the second compartment 52*a*2 are opened upwards. The antenna device 1 is to be provided in the first compartment 52*a*1 and the second compartment 52*a*2 from above.

As illustrated in (b) of FIG. 18, the support 30 of the antenna device 1 is to be sandwiched with the support plates 52*a*3 and 52*a*4 in the first compartment 52*a*1. In so doing, elastic protrusions 39*a*1 and 39*a*2, which are provided on respective side walls that are right and left surfaces of the support 30, are engaged with corresponding openings provided in respective ones of the pair of support plates 52*a*3 and 52*a*4. This causes a position of the support 30 in the first compartment 52*a*1 to be fixed, and therefore makes it unlikely for the support 30 to be detached from the support plates 52*a*3 and 52*a*4. As illustrated in (b) of FIG. 18, the film antenna 10 extending from the support 30 is provided in the second compartment 52*a*2 which is continuous with the first compartment 52*a*1. As illustrated in (b) of FIG. 18, the coaxial cable 20 drawn from the support 30 passes through a through-hole (not shown) made in a front-side wall of the first compartment 52*a*1, and is then drawn out of the first compartment 52*a*1. After the antenna device 1 is provided in the spoiler 52 as illustrated in (b) of FIG. 18, the first compartment 52*a*1 and the second compartment 52*a*2 are sealed with the lid part 52*b* as illustrated in (c) of FIG. 18.

Note that the antenna device 1α in accordance with Embodiment 2 and the antenna device 1β in accordance with Embodiment 3 can each be provided in the spoiler 52 by a method identical to the method by which the antenna device 1 in accordance with Embodiment 1 is provided in the spoiler 52.

Embodiment 4

The following description will discuss, with reference to FIG. 19, a configuration of an antenna device 1γ in accordance with Embodiment 4 of the present invention. (a) of FIG. 19 is a perspective view illustrating the antenna device 1γ. (b) of FIG. 19 is a plan view illustrating the antenna device 1γ. As is the case of the antenna device 1 in accordance with Embodiment 1, the antenna device 1γ includes a film antenna 10, a coaxial cable 20, and a support 30.

The antenna device 1γ is obtained by making changes below to the antenna 1 in accordance with Embodiment 1.

First Change: While the antenna device 1 in accordance with Embodiment 1 is configured so that the coaxial cable 20 extends widthwise across the film antenna 10 in the support 30 and the coaxial cable 20 is then drawn from the a side of the support 30, the antenna device 1γ in accordance with Embodiment 4 is configured so that the coaxial cable 20 is drawn from a front-side part of the support 30 without extending widthwise across the film antenna 10 in the support 30. Therefore, in the antenna device 1γ in accordance with Embodiment 4, (i) a recess 30*a*1, as a passage through which the coaxial cable 20 is to be drawn from the front-side part of the support 30, is provided at a center part of an upper end part of a side wall 30*a* which is a front-side surface of the support 30 and (ii) a third holding part 36 for holding the coaxial cable 20 drawn from the side of the support 30 is omitted. Note that instead of providing the recess 30*a*1 at the center part of the upper end part of the side wall 30*a* and using the recess 30*a*1 as a passage of the coaxial cable 20, it is alternatively possible to (i) provide a through-hole at the center part of the side wall 30*a* and (ii) use the through-hole as a passage of the coaxial cable 20.

Second Change: While the antenna device 1 in accordance with Embodiment 1 is configured so that the pair of elastic protrusions 39*a*1 and 39*a*2 for fixing the antenna device 1 to the spoiler 52 are provided on the right and left surfaces of the support 30, the antenna device 1γ in accordance with Embodiment 4 is configured so that the protrusions 39*b*1 and 39*b*2 for fixing the antenna device 1 to the spoiler 52 are provided in the vicinity of corresponding tips of a pair of elastic plates 39. One of the pair of elastic plates 39, which corresponds to the protrusion 39*b*1, extends frontwards from a left-side surface of the second holding part 35. The other one of the pair of elastic plates 39, which corresponds to the protrusion 39*b*2, extends frontwards from the front end part of the right-side surface of the support 30.

Third Change: While the antenna device 1 in accordance with Embodiment 1 is configured so that the bottom plate of the support 30, which is a bottom surface of the support 30, extends until it reaches the front-side surface of the support 30, the antenna device 1γ in accordance with Embodiment 4 is configured so that a bottom plate of the support 30, which is a third supporting surface 33, extends frontwards beyond the front-side surface of the support 30. The bottom plate serves as a support plate 33*e* for supporting the film antenna 10. On left and right edges of the support plate 33*e*, steps 33*e*1 and 33*e*2 are provided, respectively, so that a width of the support plate 33*e* further frontwards than the steps 33*e*1 and 33*e*2 is wider than a width of the support plate 33*e* further backwards than the steps 33*e*1 and 33*e*2.

While the antenna device 1 in accordance with Embodiment 1 is designed so as to be provided in the spoiler 52 having a housing divided into the containing part and a lid part, the antenna device 1γ in accordance with Embodiment 4 is designed so as to be provided in a spoiler 52 having a housing having an insertion slot. The changes above are based on the difference in the storing method of providing the antenna device in the spoiler 52. Note that a method of providing the antenna device 1γ in accordance with Embodiment 4 into the spoiler 52 having a housing having an insertion slot will be described later with reference to another drawing.

<<Storing Method of Providing Antenna Device in Accordance with Embodiment 4 into d Spoiler>>

The antenna device 1γ in accordance with Embodiment 4 can be suitably provided in a spoiler 52 of an automobile, particularly in a spoiler 52 having a housing having an insertion slot. A storing method of providing the antenna device 1γ in accordance with Embodiment 4 into such a spoiler 52 will be described below with reference to FIG. 20. FIG. 20 is a view illustrating the storing method of providing the antenna device 1γ into the spoiler 52. Note that in FIG. 20, a shape of the antenna device 1γ and a shape of the spoiler 52 are schematically illustrated so that the storing method can be easily recognized.

As illustrated in (a) of FIG. 20, the spoiler 52 has such a shape that a top plate 52*d*, which is a top surface of the housing, is jutting frontwards beyond a side wall which is a front surface of the housing. The housing has a compartment in which the support 30 of the antenna device 1γ is to be provided. The side wall, which is the front surface of the housing, has an insertion slot 52*c* through which the support 30 of the antenna device 1γ is to be inserted into the housing. On a bottom surface of the top plate 52*d*, L-shaped protrusions 52*d*1 and 52*d*2 for holding the support plate 33*e* of the antenna device 1γ are provided.

The antenna device 1γ is to be provided in the spoiler 52 as follows.

First, as illustrated in (b) of FIG. 20, the support plate 33*e* of the antenna device 1γ is made to come into contact with the top plate 52*d* of the spoiler 52. In so doing, a part of the support plate 33*e*, which part is located further backwards than the steps 33*e*1 and 33*e*2 and whose width is narrow, is passed through a space between the L-shaped protrusions 52*d*1 and 52*d*2. This allows the support plate 33*e* to come into contact with the top plate 52*d* without causing the support plate 33*e* to collide with the L-shaped protrusions 52*d*1 and 52*d*2.

Then, as illustrated in (c) of FIG. 20, while the support plate 33*e* is in contact with the top plate 52*d* of the spoiler 52, the antenna device 1γ is moved backwards so that the support 30 is inserted into the housing through the insertion slot 52*c* of the spoiler 52. This causes the support 30 of the antenna device 1γ to be provided in the housing of the spoiler 52, and therefore causes a part of the support plate 33*e* of the antenna device 1γ, which part is located further frontwards than the steps 33*e*1 and 33*e*2 and which is wide in width, to be held by the L-shaped protrusions 52*d*1 and 52*d*2. In a case where the pair of elastic plates 39 are bent inwards so that part of the support 30 including the protruding parts 39*b*1 and 39*b*2 is provided in the housing of the spoiler 52, a shape of the pair of elastic plates 39 returns to an original shape from an elastically deformed shape. This causes the protruding parts 39*b*1 and 39*b*2 to be hooked to the side wall which is the front surface of the housing of the spoiler 52, and therefore prevents the antenna device 1γ from accidentally coming off of the spoiler 52. Note that in a case where the antenna device 1γ is to be taken out of the spoiler 52, the antenna device 1γ can be pulled out of the spoiler 52 after parts 39*c*1 and 39*c*2 of the elastic plates 39, which parts 39*c*1 and 39*c*2 are located further frontwards than the protruding parts 39*b*1 and 39*b*2, are pressed inwards so that the elastic plates 39 are bent inwards and therefore the protruding parts 39*b*1 and 39*b*2 do not become hooked to the side wall which is the front surface of the housing of the spoiler 52.

SUMMARY

In order to attain the object, an antenna device in accordance with an embodiment of the present invention includes: a film antenna; a cable which is connected to a feed section of the film antenna; and a support, around which at least part of the film antenna is wound, the support including a holding section for holding the cable.

According to the configuration, the film antenna is wound around the support. This restricts a change in three-dimensional structure of the antenna conductor included in the film antenna. That is, it is possible to allow the antenna device to have a more stable an antenna characteristic. According to the configuration, the cable is held by the support. This allows the antenna device to have greater durability with respect to pulling of the cable.

According to the configuration, the support functions to allow the antenna device to have a more stable antenna characteristic and greater durability with respect to pulling of the cable. This allows the antenna device to have a more stable antenna characteristic and greater durability with respect to pulling of the cable without causing the structure to be complicated or larger.

The expression of "winding a film antenna around a support" used herein means that the film antenna is deformed so as be guided along surfaces of the support, so that the film antenna is prevented from being detached from the support. Note that the expression above does not only contain the meaning of winding the film antenna around the support one turn or more. For example, in a case where the support is a member having a rectangular parallelepiped shape, examples of the forms meant by the expression encompass: (i) a form in which the film antenna is deformed so as to be guided along 4 surfaces (e.g. top surface, right-side surface, bottom surface, left-side surface) of the support, so that the film antenna is prevented from being detached from the support, (ii) a form in which the film antenna is deformed so as to be guided along 3 surfaces (e.g. top surface, right-side surface, bottom surface) of the support, so that the film antenna is prevented from being detached from the support, and (iii) a form in which the film antenna is deformed so as to be guided along 2 surfaces (e.g. top surface, right-side surface) of the support, so that the film antenna is prevented from being detached from the support.

The antenna device in accordance with an aspect of the present invention is preferably configured so that: the support has a first supporting surface, a second supporting surface intersecting the first supporting surface, and a third supporting surface facing the first supporting surface and intersecting the second supporting surface; the film antenna is wound around the support so as to be in contact with the first supporting surface, the second supporting surface, and the third supporting surface; and the holding section includes a first holding part for holding the cable so that part of the cable extends in a direction along the first supporting surface and the second supporting surface.

According to the configuration, the film antenna is wound around the support so as to be in contact with the three supporting surfaces above. This makes it possible to further restrict a change in three-dimensional structure of the antenna conductor included in the film antenna. A wiring path of the part of the cable, which part extends in the direction along the first supporting surface and the second supporting surface, greatly affects the antenna characteristic. In this regard, since the part is held by the first holding part according to the configuration, the antenna characteristic can be made more stable.

The antenna device in accordance with an aspect of the present invention is preferably configured so that the first holding part is provided so as to protrude frontwards further than an end part of the first supporting surface, which end part is located opposite an end part located toward the second supporting surface.

With the configuration, it is possible to fix the cable to the first holding part even after the film antenna is wound around the support.

The antenna device in accordance with an aspect of the present invention is preferably configured so that: the film antenna includes a first antenna conductor connected to a hot side conductor of the cable and a second antenna conductor connected to a cold side conductor of the cable; the film antenna is wound around the support so that (i) a main part of the first antenna conductor is guided along the first supporting surface and (ii) a main part of the second antenna conductor is guided along the third supporting surface; and the part of the cable, which part extends in the direction along the first supporting surface and the second supporting surface, is held by the first holding part so that a first distance between the part and the first supporting surface is equal to a second distance between the part and the third supporting surface.

With the configuration, it is possible to obtain an excellent antenna characteristic.

The antenna device in accordance with an aspect of the present invention is preferably configured so that the film antenna includes a first antenna conductor connected to a hot side conductor of the cable and a second antenna conductor connected to a cold side conductor of the cable; the film antenna is wound around the support so that (i) a main part of the first antenna conductor is guided along the first supporting surface and (ii) a main part of the second antenna conductor is guided along the third supporting surface; and the part of the cable, which part extends in the direction along the first supporting surface and the second supporting surface, is held by the first holding part so that a first distance between the part and the first supporting surface is equal to or greater than a second distance between the part and the third supporting surface.

With the configuration, it is possible to obtain an excellent antenna characteristic.

The antenna device in accordance with an aspect of the present invention is preferably configured so that the holding section further includes a second holding part for holding the cable so that part of the cable is guided along the first supporting surface and extends in a direction that intersects the second supporting surface.

With the configuration, it is possible to allow the antenna device to have even greater durability with respect to pulling of the cable.

The antenna device in accordance with an aspect of the present invention is preferably configured so that the second holding part is provided outside of a spatial region sandwiched between (i) a region of the film antenna, which region is in contact with the first supporting surface and (ii) a region of the film antenna, which region is in contact with the third supporting surface.

With the configuration, it is possible to fix the cable to the first holding part even after the film antenna is wound around the support.

The antenna device in accordance with an aspect of the present invention is preferably configured so that: the second holding part has a recess whose opening faces a first direction which an opening of a recessed containing part provided in the third supporting surface faces; and the first holding part has a recess whose opening faces a second direction opposite the first direction.

With the configuration, it is possible to allow the antenna device to have greater durability with respect to pulling of the cable.

The antenna device in accordance with an aspect of the present invention is preferably configured so that part of the cable, which part is held by the first holding part and the second holding part, extends (i) between the first holding part and the second holding part and (ii) in a direction that intersects the first supporting surface and the third supporting surface.

With the configuration, it is possible to allow the antenna device to have greater durability with respect to pulling of the cable.

The antenna device in accordance with an aspect of the present invention is preferably configured so that a surface of the second holding part, which surface is in contact with a bent part of the cable, is a smooth curved surface.

With the configuration, it is possible to make it less likely for the cable to break.

The antenna device in accordance with an aspect of the present invention is preferably configured so that: the film antenna is folded in a U shape so as to be in contact with the first supporting surface, the second supporting surface, and the third supporting surface of the support; a guide ring is provided at an end part of the third supporting surface, which end part is located opposite an end part located toward the second supporting surface; and the film antenna passes through the guide ring and is supported by the guide ring.

With the configuration, it is possible to cause the film antenna to be in close contact with the support. This makes it possible to further restrict a change in three-dimensional structure of the antenna conductor.

The antenna device in accordance with an aspect of the present invention is preferably configured so that: the feed section and the cable are connected via a connection part which is covered with a resin mold part; and the support has a recessed containing part in which the resin mold part is contained.

According to the configuration, the connection part via which the feed section and the cable are connected is covered with the resin mold part, and the cable is held by the support. This allows the antenna device to have greater durability with respect to pulling of the cable.

The antenna device in accordance with an aspect of the present invention is preferably configured so that: the resin mold part includes a first covering part and a second covering part which are provided on a front surface and a back surface of the film antenna, respectively; and the first covering part and the second covering part are continuous via an opening made in the film antenna.

With the configuration, it is possible to increase a bonding strength by which the film antenna is bonded to the resin mold part. This prevents the resin mold part from peeling from the film antenna.

The antenna device in accordance with an aspect of the present invention is preferably configured so that: the recessed containing part is provided in a part of the third supporting surface, which part is located in the vicinity of a boundary between the third supporting surface and the second supporting surface; the film antenna is wound around the support so that the first covering part of the resin mold part is contained in the recessed containing part; and the first covering part and the second covering part of the resin mold part each become thinner in thickness toward a bent part of the film antenna, which bent part is bent along the boundary between the third supporting surface and the second supporting surface.

According to the configuration, the first covering part and the second covering part are each prevented, over a long period of time, from peeling from the film antenna even in a case of a configuration in which the resin mold part is located in the vicinity of the bent part of the film antenna when, for example, the film antenna, in which the connection part of the cable and the feed section is covered with the resin mold part, is wound around the support. It is therefore possible to maintain a water-resistant property of the antenna device at a high level over a long period of time. This is because of the following reason.

In addition, the first covering part and the second covering part each become thinner in thickness toward the bent part of the film antenna. This causes the first covering part and the second covering part to be more bendable toward the bent part. Therefore, stress derived from the folding can be reduced, and it is therefore possible to prevent the stress from becoming concentrated on edges of the first covering part and of the second covering part, which edges are located in the vicinity of the bent part.

An antenna device production method in accordance with an aspect of the present invention is a method of producing an antenna device, the method including the steps of: (a) connecting a cable to a feed section of a film antenna; (b) forming a resin mold part which covers the feed section and covers an end part of the cable, which end part is connected to the feed section; (c) preparing a support which (i) has: a first supporting surface; a second supporting surface intersecting the first supporting surface; and a third supporting surface facing the first supporting surface and intersecting the second supporting surface, (ii) includes a holding section for holding the cable, and (iii) has, in the third supporting surface, a recessed containing part for containing the resin mold part; (d) attaching the film antenna to the support so that the resin mold part is contained in the recessed containing part and winding the film antenna around the support so that the film antenna comes into contact with the first supporting surface, the second supporting surface, and the third supporting surface; and (e) wiring the cable so that: the cable is held by the holding section; and part of the cable extends in a direction along the first supporting surface and the second supporting surface.

With the production method, it is possible to easily produce the above described antenna device in accordance with an aspect of the present invention.

An antenna device production method in accordance with an aspect of the present invention is a method of producing an antenna device, the method including the steps of: (a) connecting a cable to a feed section of a film antenna; (b) preparing a support which (i) has: a first supporting surface; a second supporting surface intersecting the first supporting surface; and a third supporting surface facing the first supporting surface and intersecting the second supporting surface, (ii) includes a holding section for holding the cable, and (iii) has, in the third supporting surface, a recessed containing part for containing the feed section; (c) attaching the film antenna to the support so that the feed section is contained in the recessed containing part and winding the film antenna around the support so that the film antenna comes into contact with the first supporting surface, the second supporting surface, and the third supporting surface; (d) wiring the cable so that: the cable is held by the holding section; and part of the cable extends in a direction along the first supporting surface and the second supporting surface;

and (e) forming, by filling the recessed containing part with a resin material and hardening the resin material, a resin mold part which covers the feed section and covers an end part of the cable which end part is connected to the feed section, the feed section and the end part being contained in the recessed containing part.

With the production method, it is possible to easily produce the above described antenna device in accordance with an aspect of the present invention.

The antenna device production method in accordance with an aspect of the present invention preferably further includes the step of: forming, before the step of attaching and winding the film antenna is carried out, an adhesive layer in a region surrounding the recessed containing part of the third supporting surface. The step of attaching and winding the film antenna preferably further includes the step of attaching, in a case where the film antenna is to be wound around the support, the film antenna to the support with use of the adhesive layer.

According to the production method, the support and the film antenna are attached to each other by the adhesive layer in the region surrounding a contour of the recessed containing part. This prevents a gap from being made between (i) the support (particularly the third supporting surface) surrounding the contour of the recessed containing part and (ii) the film antenna. Therefore, in the region surrounding the contour of the recessed containing part, the resin material filling the recessed containing part remains in the recessed containing part. It is therefore possible to easily prevent the resin material from flowing into a gap between the support and the film antenna.

<<Additional Remarks>>

The present invention is not limited to the embodiments, but can be altered by a skilled person in the art within the scope of the claims. An embodiment derived from a proper combination of technical means each disclosed in a different embodiment is also encompassed in the technical scope of the present invention.

REFERENCE SIGNS LIST

1, 1α, 1β, 1β', 1γ Antenna device
10, 10α Film antenna
20 Coaxial cable (cable)
30, 30α, 30A, 30B Support
31 First supporting surface
31*a* L-shaped protrusion
31*b* I-shaped protrusion
32 Second supporting surface
32*a*, 32*b* L-shaped guide
33 Third supporting surface
33*a* Counter region
33*b* Non-counter region
33*c* Guide ring
34 First holding part (holding section)
34*a* Partition wall
34*b* Recess
34*c* Partition wall
35 Second holding part (holding section)
35*a* Protruding part
35*b* Recess
37, 37A, 37C First recess
38, 38A, 38B Second recess
37B L-shaped groove (groove)
37D J-shaped groove (groove)

The invention claimed is:

1. An antenna device comprising:
a film antenna;
a cable which is connected to a feed section of the film antenna; and
a support, around which at least part of the film antenna is wound,
the support including a holding section for holding the cable,
wherein:
the support has
a first supporting surface,
a second supporting surface intersecting the first supporting surface, and
a third supporting surface facing the first supporting surface and intersecting the second supporting surface;
the film antenna is wound around the support so as to be in contact with the first supporting surface, the second supporting surface, and the third supporting surface; and
the holding section includes a first holding part for holding the cable so that part of the cable extends in a direction along the first supporting surface and the second supporting surface.

2. The antenna device as set forth in claim 1, wherein
the first holding part is provided so as to protrude frontwards further than an end part of the first supporting surface, which end part is located opposite an end part of the first supporting surface located toward the second supporting surface.

3. The antenna device as set forth in claim 1, wherein:
the film antenna includes
a first antenna conductor connected to a hot side conductor of the cable and
a second antenna conductor connected to a cold side conductor of the cable;
the film antenna is wound around the support so that (i) a main part of the first antenna conductor is guided along the first supporting surface and the second supporting surface and (ii) a main part of the second antenna conductor is guided along the third supporting surface; and
the part of the cable extending in the direction along the first supporting surface and the second supporting surface, is held by the first holding part so that a first distance between the part and the first supporting surface is equal to a second distance between the part and the third supporting surface.

4. The antenna device as set forth in claim 1, wherein:
the film antenna includes
a first antenna conductor connected to a hot side conductor of the cable and
a second antenna conductor connected to a cold side conductor of the cable;
the film antenna is wound around the support so that (i) a main part of the first antenna conductor is guided along the first supporting surface and the second supporting surface and (ii) a main part of the second antenna conductor is guided along the third supporting surface; and
the part of the cable extending in the direction along the first supporting surface and the second supporting surface, is held by the first holding part so that a first distance between the part and the first supporting surface is equal to or greater than a second distance between the part and the third supporting surface.

5. The antenna device as set forth in claim 1, wherein the holding section further includes a second holding part for holding the cable so that part of the cable is guided along the first supporting surface and extends in a direction that intersects the second supporting surface.

6. The antenna device as set forth in claim 5, wherein the second holding part is provided outside of a spatial region sandwiched between (i) a region of the film antenna, which region is in contact with the first supporting surface and (ii) a region of the film antenna, which region is in contact with the third supporting surface.

7. The antenna device as set forth in claim 5, wherein:

the second holding part has a recess whose opening faces a first direction which an opening of a recessed containing part provided in the third supporting surface faces; and the first holding part has a recess whose opening faces a second direction opposite the first direction.

8. The antenna device as set forth in claim 7, wherein part of the cable, which part is held by the first holding part and the second holding part, extends (i) between the first holding part and the second holding part and (ii) in a direction that intersects the first supporting surface and the third supporting surface.

9. The antenna device as set forth in claim 8, wherein a surface of the second holding part, which surface is in contact with a bent part of the cable, is a smooth curved surface.

10. The antenna device as set forth in claim 1, wherein:

the film antenna is folded in a U shape so as to be in contact with the first supporting surface, the second supporting surface, and the third supporting surface of the support;

a guide ring is provided at an end part of the third supporting surface, which end part is located opposite an end part located toward the second supporting surface; and the film antenna passes through the guide ring and is supported by the guide ring.

11. An antenna device comprising:

a film antenna;

a cable which is connected to a feed section of the film antenna; and a support, around which at least part of the film antenna is wound, the support including a holding section for holding the cable, wherein:

the feed section and the cable are connected via a connection part which is covered with a resin mold part; and the support has a recessed containing part in which the resin mold part is contained.

12. The antenna device as set forth in claim 11, wherein:

the support has a first supporting surface, a second supporting surface intersecting the first supporting surface, and a third supporting surface facing the first supporting surface and intersecting the second supporting surface;

the film antenna is wound around the support so as to be in contact with the first supporting surface, the second supporting surface, and the third supporting surface; and the holding section includes a first holding part for holding the cable so that part of the cable extends in a direction along the first supporting surface and the second supporting surface.

13. The antenna device as set forth in claim 12, wherein:

the resin mold part includes a first covering part and a second covering part which are provided on a front surface and a back surface of the film antenna, respectively; and the first covering part and the second covering part are continuous via an opening made in the film antenna.

14. The antenna device as set forth in claim 13, wherein:

the recessed containing part is provided in a part of the third supporting surface, which part is located in the vicinity of a boundary between the third supporting surface and the second supporting surface;

the film antenna is wound around the support so that the first covering part of the resin mold part is contained in the recessed containing part; and the first covering part and the second covering part of the resin mold part each become thinner in thickness toward a bent part of the film antenna, which bent part is bent along the boundary between the third supporting surface and the second supporting surface.

* * * * *